US006985864B2

(12) United States Patent
Nagao

(10) Patent No.: US 6,985,864 B2
(45) Date of Patent: Jan. 10, 2006

(54) ELECTRONIC DOCUMENT PROCESSING APPARATUS AND METHOD FOR FORMING SUMMARY TEXT AND SPEECH READ-OUT

(75) Inventor: Katashi Nagao, Tokyo (JP)

(73) Assignee: Sony Corporation, Tokyo (JP)

( * ) Notice: Subject to any disclaimer, the term of this patent is extended or adjusted under 35 U.S.C. 154(b) by 29 days.

(21) Appl. No.: 10/926,805

(22) Filed: Aug. 26, 2004

(65) Prior Publication Data

US 2005/0055212 A1 Mar. 10, 2005

Related U.S. Application Data

(62) Division of application No. 09/763,832, filed as application No. PCT/JP00/04109 on Jun. 22, 2000.

(30) Foreign Application Priority Data

Jun. 30, 1999 (JP) ..... 11-186839

(51) Int. Cl.
*G10L 13/08* (2006.01)

(52) U.S. Cl. ..... 704/260; 704/9; 704/257; 704/270

(58) Field of Classification Search ..... 704/258–270, 704/9, 257, 270.1
See application file for complete search history.

(56) References Cited

U.S. PATENT DOCUMENTS

| | | | | |
|---|---|---|---|---|
| 4,864,502 A | | 9/1989 | Kucera et al. | |
| 5,077,668 A | | 12/1991 | Doi | |
| 5,185,698 A | | 2/1993 | Hesse et al. | |
| 5,384,703 A | | 1/1995 | Withgott et al. | |
| 5,572,625 A | | 11/1996 | Raman et al. | |
| 5,675,710 A | | 10/1997 | Lewis | |
| 5,781,886 A | * | 7/1998 | Tsujiuchi | 704/275 |
| 5,907,323 A | * | 5/1999 | Lawler et al. | 725/41 |
| 6,289,304 B1 | * | 9/2001 | Grefenstette | 704/9 |
| 6,317,708 B1 | * | 11/2001 | Witbrock et al. | 704/9 |

FOREIGN PATENT DOCUMENTS

| | | |
|---|---|---|
| EP | 0 810 582 | 12/1997 |
| EP | 0 952 533 | 10/1999 |
| JP | 9-244869 | 9/1997 |
| JP | 9-258763 | 10/1997 |
| JP | 10-105370 | 4/1998 |
| JP | 10-254861 | 9/1998 |
| JP | 10-260814 | 9/1998 |
| JP | 10-274999 | 10/1998 |
| JP | 11-52973 | 2/1999 |
| JP | 2000-99072 | 4/2000 |
| WO | WO 01 33549 | 5/2001 |

OTHER PUBLICATIONS

Taylor Paul et al: "SSML: A speech synthesis markup language" Speech Communication, Elsevier Science Publishers, Amsterdam, NL, vol. 21, No. 1, Feb. 1, 1997, pp. 123–133, XP004055059 ISSN: 0167–6393.
Patent Abstracts of Japan vol. 1998 No. 09, Jul. 31, 1998 & JP 10 105371 A (Canon Inc), Apr. 24, 1998.

* cited by examiner

*Primary Examiner*—Abul K. Azad
(74) *Attorney, Agent, or Firm*—Frommer Lawrence & Haug LLP; William S. Frommer

(57) ABSTRACT

On receipt of a tagged file, as a tagged document, at step S1, a document processing apparatus at step S2 derives the attribute information for read-out from tags of the tagged file and embeds the attribute information to generate a speech read-out file. Then, at step S3, the document processing apparatus performs processing suited for a speech synthesis engine, using the generated speech read-out file. At step S4, the document processing apparatus performs processing depending on the operation by the user through a user interface.

74 Claims, 22 Drawing Sheets

〈DOCUMENT〉〈HEADING〉〈SENTENCE〉[〈NOUN〉〈ADJECTIVE PHRASE MEANING= "3cf072" 〉素敵に〈/ADJECTIVE PHRASE 〉〈NOUN IDENTIFIER= "n200" 〉エイジング〈/NOUN 〉〈/NOUN 〉]/8〈/SENTENCE 〉〈SENTENCE 〉〈VERB PHRASE IDENTIFIER= "a876 " 〉〈ADJECTIVE VERB PHRASE RELATION="OBJECT〉〈NOUN PHRASE IDENTIFIER= "n1000" 〉〈RELATION= "SUBJECT" MEANING= "3be2c7" 〉ガン〈/NOUN PHRASE〉〈NOUN IDENTIFIER= "a8" MEANING= "0ff5e7" 〉転移〈/NOUN PHRASE 〉、〈/ADJECTIVE VERB PHRASE〉抑え〈/VERB PHRASE〉られる！？〈/SENTENCE〉〈/HEADING〉

FIG.7A

〈PARAGRAPH〉〈SENTENCE〉〈ADJECTIVE VERB PHRASE RELATION= "SUBJECT" 〉〈NOUN PHRASE CO-REFERENCE= "a89" 〉この転移〈/NOUN PHRASE 〉、〈/ADJECTIVE VERB PHRASE 〉〈ADJECTIVE VERB PHRASE RELATION= "CONDITION" 〉〈ADJECTIVE VERB PHRASE RELATION= "SUBJECT" 〉〈NOUN PHRASE IDENTIFIER= "a15" 〉〈NOUN PHRASE CO-REFERENCE = "a1" RELATION= "INDISPENSABLE" MEANING= "3be2c7" 〉がん〈/NOUN PHRASE〉〈NOUN MEANING= "0f2e4c" 〉細胞〈/NOUN〉〈/NOUN PHRASE〉が〈/ADJECTIVE VERB PHRASE〉増えるだけでは〈/ADJECTIVE VERB PHRASE〉発生しない。〈/SENTENCE〉〈SENTENCE〉〈ADJECTIVE VERB PHRASE RELATION= "SUBJECT" 〉〈NOUN PHRASE IDENTIFIER= "a18" CO-REFERENCE= "a15" 〉〈NOUN PHRASE CO-REFERENCE= "a1" RELATION= "INDISPENSABLE" 〉がん〈/NOUN PHRASE〉〈NOUN MEANING= "0f2e4c" 〉細胞〈/NOUN〉〈/NOUN PHRASE 〉が〈/ADJECTIVE VERB PHRASE〉〈ADJECTIVE VERB PHRASE RELATION= "MEANS" 〉〈ADJECTIVE VERB PHRASE RELATION = "MEANS" 〉〈ADJECTIVE VERB PHRASE RELATION= "OBJECT" 〉〈NOUN PHRASE IDENTIFIER= "a12" 〉〈ADJECTIVE VERB PHRASE RELATION= "NOT CLEAR" 〉〈ADJECTIVE VERB PHRASE RELATION= "INDIRECT OBJECT" 〉〈ADJECTIVE VERB PHRASE RELATION= " POSITION" 〉〈NOUN PHRASE UNIFYING TERM= "PARALLEL" 〉〈NOUN PHRASE MEANING= "0f2e4c" 〉細胞〈/NOUN PHRASE〉と〈NOUN PHRASE MEANING= "0f2e4c" 〉細胞〈/NOUN PHRASE〉〈/NOUN PHRASE〉の〈/ADJECTIVE VERB PHRASE〉間に〈/ADJECTIVE VERB PHRASE〉ある〈/ADJECTIVE VERB PHRASE〉〈NOUN〉〈NOUN PHRASE UNIFYING TERM= "BACKWARD DEPENDENT" 〉蛋白〈SPECIAL RELATION= "NOT CLEAR" PRONUNCIATION= "null" 〉(たんぱく)〈/SPECIAL〉〈/NOUN PHRASE〉質〈/NOUN〉〈/NOUN PHRASE〉などを〈/ADJECTIVE VERB PHRASE〉溶かし、〈/ADJECTIVE VERB PHRASE〉〈ADJECTIVE VERB PHRASE RELATION= "OBJECT" 〉〈VERB PHRASE RELATION="NOT CLEAR"〉〈ADJECTIVE VERB PHRASE RELATION = "SUBJECT" 〉〈NOUN PHRASE CO-REFERENCE= "a18" MEANING= "0f6fa3" 〉自分〈/NOUN PHRASE〉の〈/ADJECTIVE VERB PHRASE〉進む〈/VERB PHRASE〉道を〈/ADJECTIVE VERB PHRASE〉つくって、〈/ADJECTIVE VERB PHRASE〉〈ADJECTIVE VERB PHRASE RELATION= "INDIRECT OBJECT" 〉〈NOUN PHRASE IDENTIFIER= "a33" UNIFYING TERM= "PARALLEL" 〉〈NOUN PHRASE MEANING = "0ef4e6" 〉血管〈/NOUN PHRASE〉や〈NOUN PHRASE PRONUNCIATION= "RIMPAKAN " 〉リンパ管〈/NOUN PHRASE〉〈/NOUN PHRASE〉に〈/ADJECTIVE VERB PHRASE〉入り込む。〈/SENTENCE〉〈SENTENCE IDENTIFIER= "a16" 〉〈ADJECTIVE VERB PHRASE RELATION= "SUBJECT" 〉〈VERB PHRASE RELATION= "CONTENTS" 〉〈ADJECTIVE VERB PHRASE RELATION = "OBJECT" 〉〈NOUN PHRASE〉〈ADJECTIVE VERB PHRASE RELATION= "CONTENTS" 〉〈ADJECTIVE VERB PHRASE〉〈ADJECTIVE VERB PHRASE〉循環しながら〈/ADJECTIVE VERB PHRASE〉〈VERB PHRASE〉〈VERB PHRASE RELATION= "NOT CLEAR" 〉〈ADJECTIVE VERB PHRASE RELATION= "OBJECT" 〉〈ADJECTIVE VERB PHRASE RELATION= "OBJECT"〉〈NOUN PHRASE IDENTIFIER= "a69" 〉新たな"〈NOUN PRONUNCIATION= "SUMIKA" 〉住み家〈/NOUN〉"〈/NOUN PHRASE〉を〈/ADJECTIVE VERB PHRASE〉探して〈/VERB PHRASE〉潜り込む、〈/VERB PHRASE〉〈/ADJECTIVE VERB PHRASE〉といった〈/ADJECTIVE VERB PHRASE〉〈ADJECTIVE PHRASE RELATION="NOT CLEAR" MEANING= "3ce6b4" 〉複雑な〈/ADJECTIVE PHRASE〉動き〈/NOUN PHRASE〉を〈/ADJECTIVE VERB PHRASE〉する〈/VERB PHRASE〉ことが、〈/ADJECTIVE VERB PHRASE〉〈/NOUN PHRASE RELATION= "TIME" 〉近年〈/NOUN PHRASE RELATION〉解明されつつある。〈/SENTENCE〉〈/PARAGRAPH〉〈/DOCUMENT〉

FIG.7B

⟨DOCUMENT⟩ ⟨SENTENCE⟩ ⟨ADJECTIVE VERB PHRASE RELATION= "TIME" ⟩ During ⟨NOUN PHRASE RELATION= "INDISPENSABLE" ⟩ ⟨ADJECTIVE VERB PHRASE CO-REFERENCE= "wsj" ⟩ its ⟨/ADJECTIVE VERB PHRASE⟩ ⟨ADJECTIVE PHRASE⟩ centennial ⟨/ADJECTIVE PHRASE⟩ year ⟨/NOUN PHRASE⟩ , ⟨/ADJECTIVE VERB PHRASE⟩ ⟨PROPER NOUN PHRASE IDENTIFIER= "wsj" RELATION = "SUBJECT" ⟩ The Wall Street Journal ⟨/PROPER NOUN PHRASE ⟩ will report ⟨NOUN PHRASE= "OBJECT" ⟩ events ⟨ADJECTIVE VERB PHRASE⟩ of ⟨NOUN PHRASE⟩ the past century ⟨/NOUN PHRASE⟩ ⟨/ADJECTIVE VERB PHRASE⟩ ⟨COMPLEMENT TEXT⟩ ⟨NOUN PHRASE⟩ that ⟨/NOUN PHRASE⟩ stand ⟨ADJECTIVE VERB PHRASE RELATION= "INDISPENSABLE" ⟩ as ⟨NOUN PHRASE⟩ milestones ⟨ADJECTIVE VERB PHRASE⟩ of ⟨NOUN PHRASE⟩ American business history ⟨/NOUN PHRASE⟩ ⟨/ADJECTIVE VERB PHRASE⟩ ⟨/NOUN PHRASE⟩ ⟨/ADJECTIVE VERB PHRASE⟩ ⟨/COMPLEMENT TEXT⟩ ⟨/NOUN PHRASE⟩ ⟨/SENTENCE⟩ ⟨SENTENCE⟩ ⟨NOUN PHRASE CO-REFERENCE = "a3" RELATION = "SUBJECT"⟩ ⟨CARDINAL NUMBER PHRASE TYPE= "INTEGER" VALUE= "3" RELATION= "INDISPENSABLE" ⟩ THREE ⟨/CARDINAL NUMBER PHRASE⟩ COMPUTERS ⟨COMPLEMENT TEXT⟩ THAT CHANGED ⟨NOUN PHRASE RELATION= "OBJECT" ⟩ the face ⟨/ADJECTIVE VERB PHRASE⟩ of ⟨NOUN PHRASE⟩ personal computing ⟨/NOUN PHRASE⟩ ⟨/ADJECTIVE VERB PHRASE⟩ ⟨/NOUN PHRASE⟩ ⟨/COMPLEMENT TEXT⟩ ⟨/NOUN PHRASE⟩ were launched ⟨ADJECTIVE VERB PHRASE RELATION= "TIME" ⟩ in ⟨DATE PHRASE IDENTIFIER= "a1977" ⟩ 1977 ⟨/DATE PHRASE⟩ ⟨/ADJECTIVE VERB PHRASE⟩ ⟨/SENTENCE⟩ ⟨SENTENCE⟩ ⟨DATE PHRASE⟩ That year ⟨/DATE PHRASE⟩ ⟨PROPER NOUN PHRASE IDENTIFIER= "a3" UNIFYING TERM = "PARALLEL" RELATION= "SUBJECT" ⟩ the ⟨PROPER NOUN PHRASE IDENTIFIER= "a2" ⟩ Apple ⟨NOUN PHRASE PRONUNCIATION= "two" ⟩ II ⟨/NOUN PHRASE⟩ ⟨/PROPER NOUN PHRASE ⟩ , ⟨PROPER NOUN PHRASE IDENTIFIER= "cp" ⟩ Commodore Pet ⟨/PROPER NOUN PHRASE⟩ and ⟨PROPER NOUN PHRASE IDENTIFIER= "trs" ⟩ Tandy TRS ⟨/PROPER NOUN PHRASE ⟩ ⟨/PROPER NOUN PHRASE ⟩ came ⟨ADJECTIVE VERB PHRASE RELATION = "INDISPENSABLE" ⟩ to market ⟨/ADJECTIVE VERB PHRASE⟩ , ⟨/SENTENCE⟩ ⟨CONTINUING SENTENCE⟩ ⟨SENTENCE⟩ ⟨NOUN PHRASE CO-REFERENCE= "a3" RELATION= "SUBJECT"⟩ The computers ⟨/NOUN PHRASE ⟩ were ⟨ADJECTIVE PHRASE IDENTIFIER="a87" RELATION= "INDISPENSABLE"⟩ crude ⟨/ADJECTIVE PHRASE⟩ ⟨ADJECTIVE VERB PHRASE⟩ by ⟨NOUN PHRASE⟩ ⟨/ADJECTIVE VERB PHRASE⟩ today's ⟨/ADJECTIVE VERB PHRASE⟩ standards ⟨/NOUN PHRASE⟩ ⟨/ADJECTIVE VERB PHRASE⟩ ⟨/SENTENCE⟩ ⟨SENTENCE IDENTIFIER= "a222" RELATION= "EXAMPLE"⟩ ⟨NOUN PHRASE IDENTIFIER= "aonrs" RELATION = "SUBJECT" ⟩ ⟨PROPER NOUN PHRASE CO-REFERENCE= "a2" ⟩ Apple ⟨NOUN PRONUNCIATION= "two" ⟩ II ⟨/NOUN PHRASE⟩ ⟨/PROPER NOUN PHRASE⟩ owners ⟨/NOUN PHRASE⟩ ⟨ADJECTIVE VERB PHRASE RELATION= "NOT CLEAR" ⟩ ,for example, ⟨/ADJECTIVE VERB PHRASE⟩ ⟨VERB PHRASE UNIFYING TERM= "PARALLEL" ⟩ ⟨VERB PHRASE⟩ had to use ⟨NOUN PHRASE RELATION = "OBJECT" ⟩ ⟨ADJECTIVE VERB PHRASE CO-REFERENCE = "aonrs" ⟩ their ⟨/ADJECTIVE VERB PHRASE⟩ television sets ⟨/NOUN PHRASE⟩ ⟨ADJECTIVE VERB PHRASE⟩ as screens ⟨/ADJECTIVE VERB PHRASE⟩ ⟨/VERB PHRASE⟩ and ⟨VERB PHRASE⟩ stored ⟨NOUN PHRASE RELATION= "OBJECT" ⟩ data ⟨/NOUN PHRASE⟩ ⟨ADJECTIVE VERB PHRASE RELATION= "INDIRECT OBJECT" ⟩ on ⟨/ADJECTIVE VERB PHRASE⟩ ⟨/ VERB PHRASE⟩ ⟨/VERB ⟩ , ⟨/SENTENCE⟩ ⟨/CONTINUING SENTENCE⟩ ⟨/DOCUMENT⟩

FIG.8

¥Com=Lang=JPN¥¥Pau=100¥¥Com=begin_s¥ [¥Pau=50¥¥Com=begin_ph¥素敵にエイジング]
／8 ¥Pau=100¥¥Com=begin_s¥¥Pau=50¥¥Com=begin_ph¥ガン転移、抑えられる！？

FIG.9A

¥Pau=50¥¥Com=begin_p¥¥Pau=100¥¥Com=begin_s¥¥Pau=50¥¥Com=begin_ph¥この転移、
¥Pau=50¥¥Com=begin_ph¥がん細胞が増えるだけでは発生しない。
¥Pau=100¥¥Com=begin_s¥¥Pau=50¥¥Com=begin_ph¥がん細胞が¥Pau=50¥¥Com=begin_ph¥細
胞と¥Pau=50¥¥Com=begin_ph¥細胞の間にある¥Pau=50¥¥Com=begin_ph¥蛋白質などを溶かし、
¥Pau=50¥¥Com=begin_ph¥自分の進む道をつくって、¥Pau=50¥¥Com=begin_ph¥血管や
¥Pau=50¥¥Com=begin_ph¥りんぱかんに入り込む。
¥Pau=100¥¥Com=begin_s¥¥Pau=50¥¥Com=begin_ph¥循環しながら¥Pau=50¥¥Com=begin_ph¥
新たな“すみか”を探して潜り込む、といった¥Pau=50¥¥Com=begin_ph¥複雑な動きをすること
とが、¥Pau=50¥¥Com=begin_ph¥近年解明されつつある。

FIG.9B

¥Com=Lang=ENG¥¥Pau=100¥¥Com=begin_s¥¥Com=Vol=0¥¥Pau=50¥¥Com=begin_ph¥During ¥Pau=50¥¥Com=begin_ph¥its ¥Pau=50¥¥Com=begin_ph¥centennial year, ¥Pau=50¥¥Com=begin_ph¥The Wall Street Journal will report ¥Pau=50¥¥Com=begin_ph¥events ¥Pau=50¥¥Com=begin_ph¥of¥Pau=50¥¥Com=begin_ph¥the past century ¥Pau=50¥¥Com=begin_ph¥that stand ¥Pau=50¥¥Com=begin_ph¥as¥Pau=50¥¥Com=begin_ph¥milestones ¥Pau=50¥¥Com=begin_ph¥of ¥Pau=50¥¥Com=begin_ph¥American business history. ¥Pau=100¥¥Com=begin_s¥¥Com=Vol=80¥¥Pau=50¥¥Com=begin_ph¥THREE COMPUTERS THAT CHANGED ¥Pau=50¥¥Com=begin_ph¥the face ¥Pau=50¥¥Com=begin_ph¥of¥Pau=50¥¥Com=begin_ph¥personal computing were launched ¥Pau=50¥¥Com=begin_ph¥in¥Pau=50¥¥Com=begin_ph¥1977. ¥Pau=100Com=begin_s¥¥Com=Vol=80¥¥Pau=50¥¥Com=begin_ph¥That year¥Pau=50¥¥Com=begin_ph¥the ¥Pau=50¥¥Com=begin_ph¥Apple ¥Pau=50¥¥Com=begin_ph¥two,¥Pau=50¥¥Com=begin_ph¥Commodore Pet and ¥Pau=50¥¥Com=begin_ph¥Tandy TRS came¥Pau=50¥¥Com=begin_ph¥to market. ¥Pau=100¥¥Com=begin_s¥¥Com=Vol=80¥¥Pau=50¥¥Com=begin_ph¥The computers were ¥Pau=50¥¥Com=begin_ph¥curde ¥Pau=50¥¥Com=begin_ph¥by¥Pau=50¥¥Com=begin_ph¥today's standards.¥Pau=100¥¥Com=begin_s¥¥Com=Vol=0¥¥Pau=50¥¥Com=begin_ph¥Apple two owners¥Pau=50¥¥Com=begin_ph¥, for example,¥Pau=50¥¥Com=begin_ph¥ had to use¥Pau=Com=begin_ph¥their television sets ¥Pau=50¥¥Com=begin_ph¥as screens and¥Pau=50¥¥Com=begin_ph¥stored ¥Pau=50¥¥Com=begin_ph¥data ¥Pau=50¥¥Com=begin_ph¥on audiocasettes.

FIG.10

ELECTRONIC DOCUMENT PROCESSING APPARATUS AND METHOD FOR FORMING SUMMARY TEXT AND SPEECH READ-OUT

This is a divisional of U.S. application Ser. No. 09/763,832, filed Jun. 18, 2001 , which is a 371 of PCT/JP00/04109, filed Jun. 22, 2000, the disclosure of which is incorporated herein by reference.

TECHNICAL FIELD

This invention relates to an electronic document processing apparatus for processing electronic documents.

BACKGROUND ART

Up to now, a WWW (World Wide Web) is presented in the Internet as an application service furnishing the hypertext type information in the window form.

The WWW is a system executing document processing for document formulation, publication or co-owning for showing what should be the document of a new style. However, from the standpoint of actual document utilization, an advanced documentation surpassing the WWW, such as document classification or summary derived from document contents, is retained to be desirable. For this advanced document processing, mechanical processing of the document contents is indispensable.

However, mechanical processing of the document contents is still difficult for the following reason. First, the HTML (Hyper Text Markup Language), as a language stating the hypertext, prescribing the expression in the document, scarcely prescribes the document contents. Second, the network of the hypertext network, formed between the documents, is not necessarily utilizable readily for a reader of the document desirous to understand the document contents. Third, an author of a document writes without taking the convenience in reading for a reader into account, however, it never occurs that the convenience for the reader of the document is compromised with the convenience for the author.

That is, the WWW, which is a system showing what should be the new document, is unable to perform advanced document processing because it cannot process the document mechanically. Stated differently, mechanical document processing is necessary in order to execute highly advanced document processing.

In this consideration, a system for supporting the mechanical document processing has been developed on th basis of the results of investigations into natural languages. There has been proposed the mechanical document processing exploiting the attribute information or tags as to the inner structure of the document affixed by the authors of the document.

Meanwhile, the user exploits an information retrieval system, such as a so-called search engine, to search the desired information from the voluminous information purveyed over the Internet. This information retrieval system is a system for retrieving the information based on the specified keyword to furnish the retrieved information to the user, who then selects the desired information from the so-furnished information.

In the information retrieval system, the information can be retrieved in this manner extremely readily. However, the user has to take a glance of the information furnished on retrieval to understand the schematics to check whether or not the information is what the or she desires. This operation means a significant load on the user if the furnished information is voluminous. So, notice is recently directed to a so-called automatic summary formulating system which automatically summarizes the contents of the text information, that is document contents.

The automatic summary formulating system is such a system which formulates a summary by decreasing the length or complexity of the text information while retaining the purport of the original information, that is the document. The user may take a glance through the summary prepared by this automatic summary formulating system to understand the schematics of the document.

Usually, the automatic summary formulating system adds the degree of importance derived from some information to the sentences or words in the text as units by way of sequencing. The automatic summary formulating system agglomerates the sentences or words of an upper order in the sequence to formulate a summary.

Recently, with the coming into extensive use of computers and in networking, there is raised a demand towards higher functions of document processing, in particular towards the function of speech-synthesizing and reading the document out.

Inherently, speech synthesis generates the speech mechanically based on the results of speech analysis and on the simulation of the speech generating mechanism of the human being, and assembles elements or phonemes of the individual language under digital control.

However, with speech synthesis, a given document cannot be read out taking the interruptions in the document into account, such that natural reading cannot be achieved. Moreover, in speech synthesis, the user has to select a speech synthesis engine depending on the particular language used. Also, in speech synthesis, the precision in correct reading of words liable to misreading, such as specialized terms or Chinese words difficult to pronounce in Japanese, depends on the particular dictionary used. In addition, if a summary text is prepared, it can be visually grasped that the portion of the text is critical, however, it is difficult to attract the user's attention if speech synthesis is used.

DISCLOSURE OF THE INVENTION

In view of the above-depicted status o the art, it is an object of the present invention to provide an electronic document processing method and apparatus whereby a given document can be read out by speech synthesis to high precision without extraneous feeling and under stressing critical text portions, and a recording medium having an electronic document processing program recorded thereon.

For accomplishing the above object, the present invention provides an electronic document processing apparatus for processing an electronic document, including document inputting means fed with an electronic document, and speech read-out data generating means for generating speech read-out data for reading out by a speech synthesizer based on the electronic document.

In this electronic document processing apparatus, according to the present invention, speech read-out data is generated based on the electronic document.

For accomplishing the above object, the present invention provides an electronic document processing method for processing an electronic document, including a document inputting step of being fed with an electronic document, and a speech read-out data generating step of generating speech read-out data for reading out by a speech synthesizer based on the electronic document.

In this electronic document processing method, according to the present invention, speech read-out data is generated based on the electronic document.

For accomplishing the above object, the present invention provides a recording medium having recorded thereon a computer-controllable electronic document processing program for processing an electronic document, in which the program includes a document inputting step of being fed with an electronic document, and a speech read-out data generating step of generating speech read-out data for reading out by a speech synthesizer based on the electronic document.

In this recording medium, having recorded thereon a computer-controllable electronic document processing program for processing an electronic document, the program generates speech read-out data based on the electronic document.

For accomplishing the above object, the present invention provides an electronic document processing apparatus for processing an electronic document, including document inputting means for being fed with the electronic document of a hierarchical structure having a plurality of elements and to which is added the tag information indicating the inner structure of the electronic document, and document read-out means for speech-synthesizing and reading out the electronic document based on the tag information.

In this electronic document processing apparatus, according to the present invention, the electronic document, to which is added the tag information indicating its inner structure, is input, and the electronic document is directly read out based on the tag information added to the electronic document.

For accomplishing the above object, the present invention provides an electronic document processing method for processing an electronic document, including a document inputting step of being fed with the electronic document of a hierarchical structure having a plurality of elements and to which is added the tag information indicating the inner structure of the electronic document, and a document read-out step of speech-synthesizing and reading out the electronic document based on the tag information.

In this electronic document processing method, according to the present invention, the electronic document, having a plurality of elements, and to which is added the tag information indicating the inner structure of the electronic document, is input, and the electronic document is directly read out based on the tag information added to the electronic document.

For accomplishing the above object, the present invention provides a recording medium having recorded thereon a computer-controllable electronic document processing program for processing an electronic document, in which the program includes a document inputting step of being fed with the electronic document of a hierarchical structure having a plurality of elements and having added thereto the tag information indicating its inner structure, and a document read-out step of speech-synthesizing and reading out the electronic document based on the tag information.

In this recording medium, having a computer-controllable electronic document processing program, recorded thereon, there is provided an electronic document processing program in which the electronic document of a hierarchical structure having a plurality of elements and having added thereto the tag information indicating its inner structure is input and in which the electronic document is directly read out based on the tag information added to the electronic document.

For accomplishing the above object, the present invention provides an electronic document processing apparatus for processing an electronic document, including summary text forming means for forming a summary text of the electronic document, and speech read-out data generating means for generating speech read-out data for reading the electronic document out by a speech synthesizer, in which the speech read-out data generating means generates the speech read-out data as the attribute information indicating reading out a portion of the electronic document included in the summary text with emphasis as compared to a portion thereof not included in the summary text.

In this electronic document processing apparatus, according to the present invention, the attribute information indicating reading out a portion of the electronic document included in the summary text with emphasis as compared to a portion thereof not included in the summary text is added in generating the speech read-out data.

For accomplishing the above object, the present invention provides a recording program having recorded thereon a computer-controllable program for processing an electronic document, in which the program includes a summary text forming step of forming a summary text of the electronic document, and a speech read-out data generating step of generating speech read-out data for reading the electronic document out by a speech synthesizer. The speech read-out data generating step generates the speech read-out data as it adds the attribute information indicating reading out a portion of the electronic document included in the summary text with emphasis as compared to a portion thereof not included in the summary text.

In this recording program having recorded thereon a computer-controllable program for processing an electronic document, there is provided an electronic document processing program in which the attribute information indicating reading out a portion of the electronic document included in the summary text with emphasis as compared to a portion thereof not included in the summary text is added in generating speech read-out data.

For accomplishing the above object, the present invention provides an electronic document processing apparatus for processing an electronic document, including summary text forming means for preparing a summary text of the electronic document, and document read-out means for reading out a portion of the electronic document included in the summary text with emphasis as compared to a portion thereof not included in the summary text.

In this electronic document processing apparatus, according to the present invention, the portion of the electronic document included in the summary text is read out with emphasis as compared to the portion thereof not included in the summary text.

For accomplishing the above object, the present invention provides an electronic document processing method for processing an electronic document, including a summary text forming step for forming a summary text of the electronic document, and a document read out step of reading out a portion of the electronic document included in the summary text with emphasis as compared to the portion thereof not included in the summary text.

In the electronic document processing method, according to the present invention, the portion of the electronic document included in the summary text is read out with emphasis as compared to the portion thereof not included in the summary text.

For accomplishing the above object, the present invention provides a recording medium having recorded thereon a computer-controllable electronic document processing program for processing an electronic document, the program including a summary text forming step for forming a summary text of the electronic document, and a document read out step of reading out a portion of the electronic document included in the summary text with emphasis as compared to the portion thereof not included in the summary text.

In this recording medium, having recorded thereon the electronic document processing program, according to the present invention, there is provided an electronic document processing program in which the portion of the electronic document included in the summary text is read out with emphasis as compared to the portion thereof not included in the summary text.

For accomplishing the above object, the present invention provides an electronic document processing apparatus for processing an electronic document including detection means for detecting beginning positions of at least two of the paragraph, sentence and phrase among plural elements making up the electronic document, and speech read-out data generating means for reading the electronic document out by the speech synthesizer by adding to the electronic document speech read-out data the attribute information indicating providing respective different pause periods at beginning positions of at least two of the paragraph, sentence and phrase based on detected results obtained by the detection means.

In this electronic document processing apparatus, according to the present invention, the attribute information indicating providing respective different pause periods at beginning positions of at least two of the paragraph, sentence and phrase is added in generating speech read-out data.

For accomplishing the above object, the present invention provides an electronic document processing method for processing an electronic document including a detection step of detecting beginning positions of at least two of the paragraph, sentence and phrase among plural elements making up the electronic document, and a speech read-out data generating step of reading the electronic document out by the speech synthesizer by adding to the electronic document speech read-out data the attribute information indicating providing respective different pause periods at beginning positions of at least two of the paragraph, sentence and phrase based on detected results obtained by the detection means.

In this electronic document processing method, according to the present invention, the attribute information indicating providing respective different pause periods at beginning positions of at least two of the paragraph, sentence and phrase is added to generate speech read-out data.

For accomplishing the above object, the present invention provides a recording medium having recorded thereon a computer-controllable electronic document processing program for processing an electronic document, in which the program includes a detection step of detecting beginning positions of at least two of the paragraph, sentence and phrase among plural elements making up the electronic document, and a step of generating speech read-out data for reading out in a speech synthesizer by adding to the electronic document the attribute information indicating providing respective different pause periods at beginning positions of at least two of the paragraph, sentence and phrase.

In the recording medium having recorded thereon a computer-controllable electronic document processing program for processing an electronic document, according to the present invention, there is provided an electronic document processing program in which the attribute information indicating providing respective different pause periods at beginning positions of at least two of the paragraph, sentence and phrase is added to generate speech read-out data.

For accomplishing the above object, the present invention provides an electronic document processing apparatus for processing an electronic document including detection means for detecting beginning positions of at least two of the paragraph, sentence and phrase among plural elements making up the electronic document, and document read out means for speech-synthesizing and reading out the electronic document by providing respective different pause periods at beginning positions of at least two of the paragraph, sentence and phrase, based on the result of detection by the detection means.

In the electronic document processing apparatus, according to the present invention, the electronic document is read out by providing respective different pause periods at beginning positions of at least two of the paragraph, sentence and phrase.

For accomplishing the above object, the present invention provides an electronic document processing method for processing an electronic document including a detection step for detecting beginning positions of at least two of the paragraph, sentence and phrase among plural elements making up the electronic document, and a document read-out step for speech-synthesizing and reading out the electronic document by providing respective different pause periods at beginning positions of at least two of the paragraph, sentence and phrase, based on the result of detection by the detection step.

In the electronic document processing method, the electronic document is read out as respective different pause periods are provided at beginning positions of at least two of the paragraph, sentence and phrase.

For accomplishing the above object, the present invention provides a recording medium having recorded thereon a computer-controllable electronic document processing program for processing an electronic document, in which the program includes a detection step for detecting beginning positions of at least two of the paragraph, sentence and phrase among plural elements making up the electronic document, and a document read-out step for speech-synthesizing and reading out the electronic document, as respective different pause periods are provided at beginning positions of at least two of the paragraph, sentence and phrase, based on the result of detection by the detection step.

In this recording medium, having recorded thereon a computer-controllable electronic document processing program for processing an electronic document, according to the present invention, there is provided an electronic document processing program in which the electronic document is read out as respective different pause periods are provided at beginning positions of at least two of the paragraph, sentence and phrase.

BRIEF DESCRIPTION OF THE DRAWINGS

FIG. 7A shows a tag file which is a tagged Japanese document shown in FIG. 5 and specifically shows its heading portion.

FIG. 7B shows a tag file which is the tagged Japanese document shown in FIG. 5 and specifically shows its last paragraph.

FIG. 8 shows a tag file which is a tagged Japanese document shown in FIG. 5

FIG. 9A shows a speech reading file generated from the tag file shown in FIG. 7 and corresponds to extract of the heading portion shown in FIG. 7A.

FIG. 9B shows a speech reading file generated from the tag file shown in FIG. 7 and corresponds to extract of the last paragraph shown in FIG. 7B.

FIG. 10 shows a speech reading file generated from the tag file shown in FIG. 8.

BEST MODE FOR CARRYING OUT THE INVENTION

Figure 1:
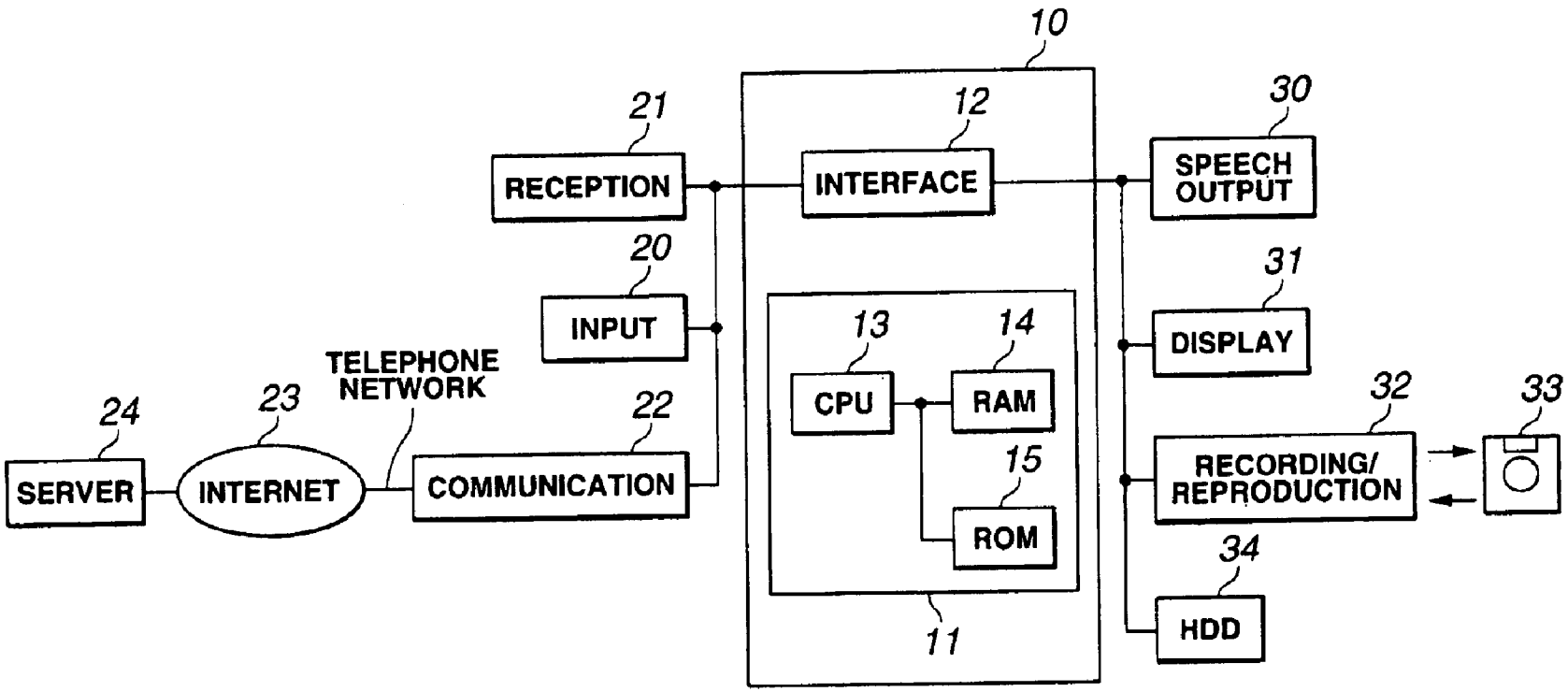
FIG. 1 is a block diagram for illustrating the configuration of a document processing apparatus embodying the present invention.

Referring to the drawings, certain preferred embodiments of the present invention are explained in detail.

A document processing apparatus, embodying the present invention, has the function of processing a given electronic document or a summary text prepared therefrom with a speech synthesis engine for speech synthesis for reading out. In reading out the electronic document or summary text, the elements comprehended in the summary text are read out with an increased volume, whilst the paragraphs making up the electronic document or the summary text, or the start positions of the sentences and phrases, are read out with a pre-set pause period. In the following description, the electronic document is simply termed a document.

Referring to FIG. 1, the document processing apparatus includes a main body portion 10, having a controller 11 and an interface 12, an input unit 20 for furnishing the information input by a user to the main body portion 10, a receiving unit 21 for receiving an external signal to supply the received signal to the main body portion 10, a communication unit 22 for performing communication between a server 24 and the main body portion 10, a speech output unit 30 for outputting the information input by the user to the main body portion 10 and a display unit 31 for demonstrating the information output from the main body portion 10. The document processing apparatus also includes a recording and/or reproducing unit 32 for recording and/or reproducing the information to or from a recording medium 33, and a hard disc drive HDD 34.

The main body portion 10 includes a controller 11 and an interface 12 and forms a major portion of this document processing apparatus.

The controller 11 includes a CPU (central processing unit) 13 for executing the processing in this document processing apparatus, a RAM (random access memory) 14, as a volatile memory, and a ROM (read-only memory) 15 as a non-volatile memory.

The CPU 13 manages control to execute a program in accordance with a program recorded on e.g., the ROM 15 or on the hard disc. In the RAM 14 are transiently recorded a program or data necessary for executing variable processing operations.

The interface 12 is connected to the input unit 20, receiving unit 21, communication unit 22, display unit 31, recording and/or reproducing unit 32 and to the hard disc drive 34. The interface 12 operates under control of the controller 11 to adjust the data input/output timing in inputting data furnished from the input unit 20, receiving unit 21 and the communication unit 22, outputting data to the display unit 31 and inputting/outputting data to or from the recording and/or reproducing unit 32 to convert the data form.

The input unit 20 is a portion receiving a user input to this document processing apparatus. This input unit 20 is formed by e.g., a keyboard or a mouse. The user employing this input unit 20 is able to input a key word by a keyboard or select and elements of a document demonstrated on the display unit 31 by a mouse. Meanwhile, the elements denote elements making up the document and comprehends e.g., a document, a sentence and a word.

The receiving unit 21 receives data transmitted from outside via e.g., a communication network. The receiving unit 21 receives plural documents, as electronic documents, and an electronic document processing program for processing these documents. The data received by the receiving unit 21 is supplied to the main body portion 10.

The communication unit 22 is made up e.g., of a modem or a terminal adapter, and is connected over a telephone network to the Internet 23. To the Internet 23 is connected the server 24 which holds data such as documents. The communication unit 22 is able to access the server 24 over the Internet 23 to receive data from the server 24. The data received by the communication unit 22 is sent to the main body portion 10.

The speech output unit 30 is made up e.g., of a loudspeaker. The speech output unit 30 is fed over the Interface 12 with electrical speech signals obtained on speech synthesis by e.g., a speech synthesis engine or other variable speech signals. The speech output unit 30 outputs the speech converted from the input signal.

The display unit 31 is fed over the interface 12 with text or picture information to display the input information. Specifically, the display unit 31 is made up e.g., of a cathode ray tube (CRT) or a liquid crystal display (LCD) and demonstrates one or more windows on which to display the text or figures.

The recording and/or reproducing unit 32 records and/or reproduces data to or from a removable recording medium 33, such as a floppy disc, an optical disc or a magneto-optical disc. The recording medium 33 has recorded therein an electronic processing program for processing documents and documents to be processed.

The hard disc drive 34 records and/or reproduces data to or from a hard disc as a large-capacity magnetic recording medium.

The document processing apparatus, described above, receives a desired document to demonstrate the received document on the display unit 31, substantially as follows:

In the document processing apparatus, if the user first acts on the input unit 20 to boot a program configured for having communication over the Internet 23 to input the URL (uniform resource locator) of the server 24, the controller 11 controls the communication unit 22 to access the server 24.

The server 24 accordingly outputs data of a picture for retrieval to the communication unit 22 of the document processing apparatus overt the Internet 23. In the document processing apparatus, the CPU 13 outputs the data over the interface 12 on the display unit 31 for display thereon.

In the document processing apparatus, if the user inputs e.g., a keyword on the retrieval picture, using the input unit 20 to command retrieval, a command for retrieval is transmitted from the communication unit 22 over the Internet 23 to the server 24 as a search engine.

On receipt of the retrieval command, the server 24 executes the this retrieval command to transmit the result of retrieval to the communication unit 22. In the document processing apparatus, the controller 11 controls the communication unit 22 to receive the result of retrieval transmitted from the server 24 to demonstrate its portion on the display unit 31.

If specifically the user has input a keyword TCP using the input unit 20, the variable information including the keyword TCP is transmitted from the server 24 so that the following document, for example, is demonstrated on the display unit 31; "TCP/IP (Transmission Control Protocol/Internet Protocol)の歴史は、北米の、いや世界のコンピュータネットワークの歴史であるといっても過言ではない。そしてその TCP/IP の歴史は、ARPENET を抜きにして語ることはできない。ARPENET は正式名称を Advanced Research Project Agency Network 高等研究計画局ネットワークといい、アメリカ国防省の DOD (Department of Defence) の国防高等研究計画局 (DARPA: Defence Advanced Research Project Agency)がスポンサーとなって構築されてきた、実験および研究用のパケット交換ネットワークである。1969年北米西海岸の個所の大学、研究機関のホストコンピュータを 50 kbpsの回線で結んだきわめて小規模なネットワークからは出発した。当時は1945年に世界初のコンピュータである ENIAC がペンシルバニア大学で開発され、1964年にはじめて ICを理論素子として実装し、第3世代学で開発され、年にはじめてを理論素子として実装し、第3世代タの歴史を形成したメインフレームの汎用コンピュータシリーズが開発され、やっとコンピュータが産声をあげたた。この時" (which reads: "It is not too much to say that the history of TCP/IP (Transmission Control Protocol/Internet protocol) is the history of the computer network of North America or even that of the world. The history of the TCP/IP cannot be discussed if APPANET is discounted. The APPANET, an acronym of Advanced Research Project Agency Network, is a packet exchanging network for experimentation and research constructed under the sponsorship of the DARPA (Defence Advanced Research Project Agency) of the DOD (Department of Defence) of the Department of Defence. The APPANET was initiated from a network of an extremely small scale which has interconnected host computers of four universities and research laboratories on the west coast of North America in 1969.

Historically, the ENIAC, as the first computer in the world, was developed in 1945 in Pennsylvania University. A general-purpose computer series, loaded for the first time with an IC as a theoretical device, and which commenced the history of the third generation computer, was developed in 1964, marking the beginning of a usable computer. In light of this historical background, it may even be said that such project, which predicted the prosperity of future computer communication, is truly American".)

This document has its inner structure described by the tagged attribute information as later explained. The document processing in the document processing apparatus is by referencing tags added to the document. That is, in the present embodiment, not only the syntactic tags, representing a document structure, but also the semantic and pragmatic tags, which enable mechanical understanding of document contents among plural languages, are added to the document.

Figure 2:
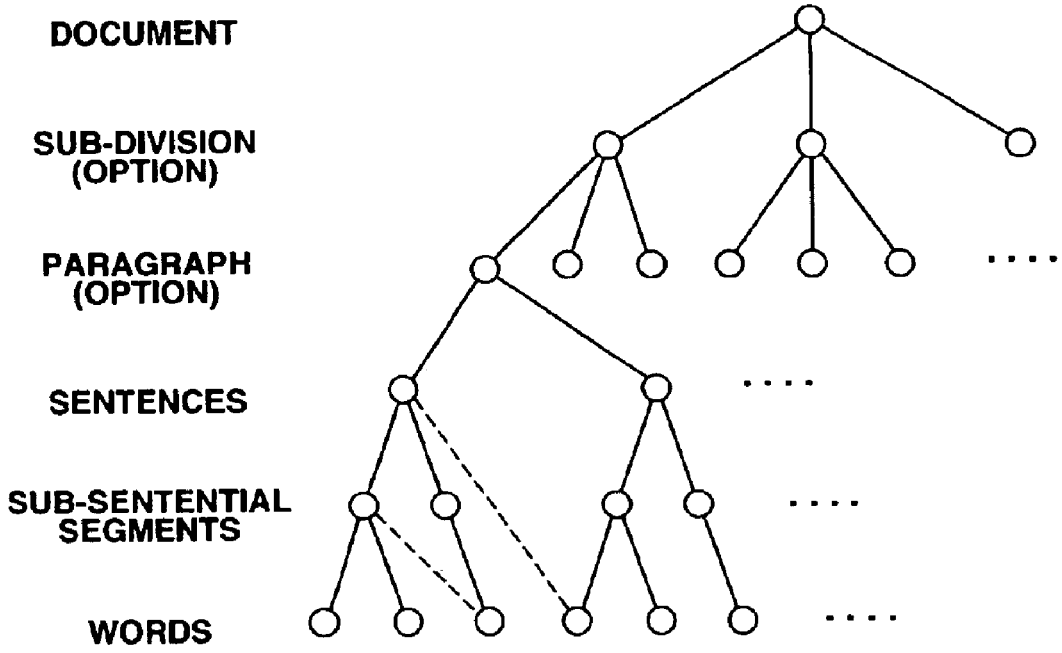
FIG. 2 illustrates an inner structure of a document.
Figure 3:
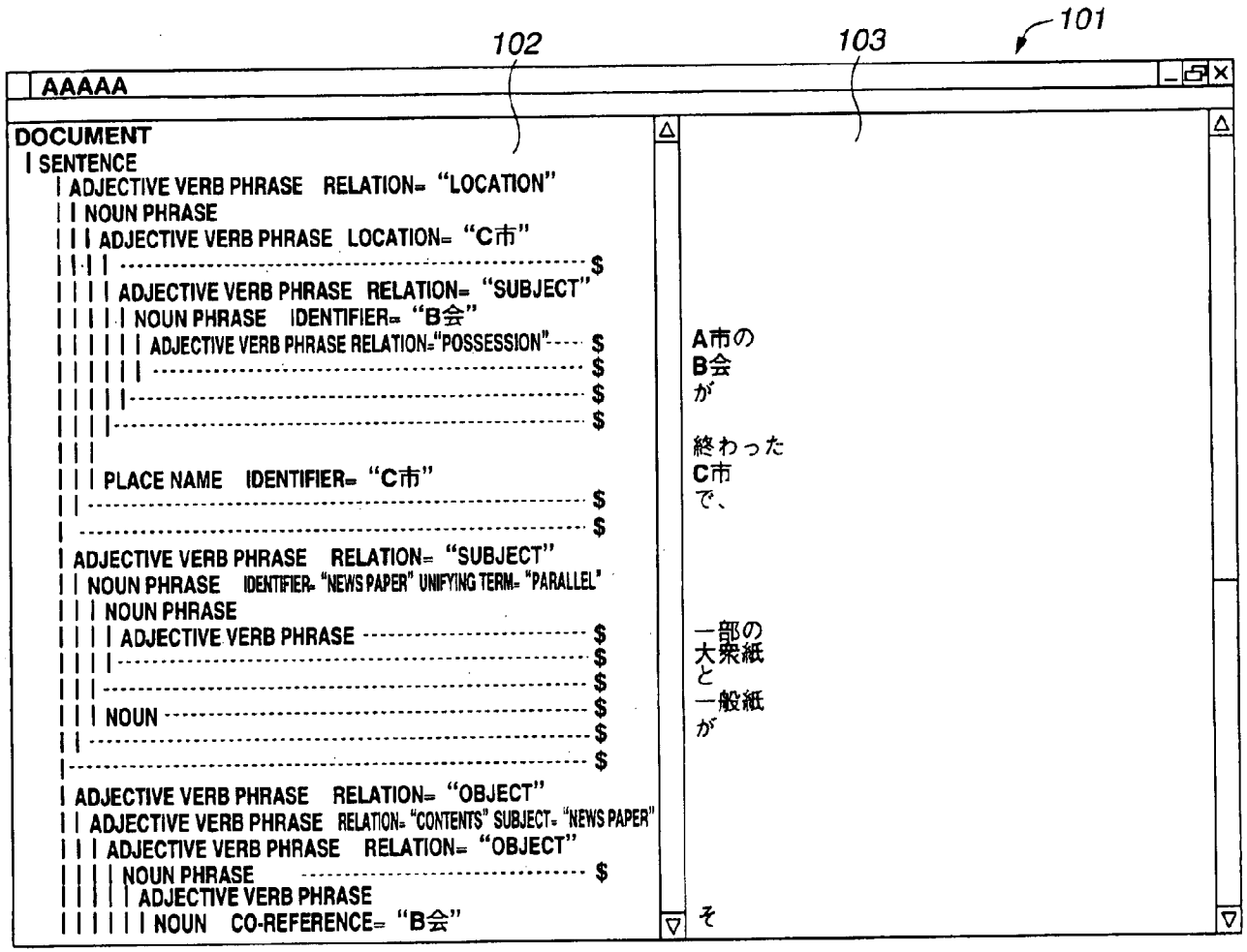
FIG. 3 illustrates the display contents of a display unit and shows a window in which the inner structure of a document is indicated by tags.

Among syntactic tagging, there is a tagging stating a tree-like inner document structure. That is, in the present embodiment, the inner structure by tagging, elements, such as document, sentences or vocabulary elements, normal links, referencing links or referenced links, are previously added as tags to the document. In FIG. 2, white circles ○ denote document elements, such as vocabulary, segments or sentences, with the lowermost circles ○ denoting vocabulary elements corresponding to the smallest level words in the document. The solid lines denote normal links indicating connection between document elements, such as words, phrases, clauses or sentences, whilst broken lines denote reference links indicating the modifying/modified relation by the referencing/referenced relation. The inner document structure is comprised of a document, subdivision, paragraph, sub-sentential segment, . . . , vocabulary elements. Of these, the subdivision and the paragraphs are optional.

The semantic and pragmatic tagging includes tagging pertinent to the syntactic structure representing the modifying/modified relation, such as an object indicated by a pronoun, and tagging stating the semantic information, such as meaning of equivocal words. Th tagging in the present embodiment is of the form of XML (eXtensible Markup Language) similar to the HTML (Hyper Text Markup Language).

Although a typical inner structure of a tagged document is shown below, it is noted that the document tagging is not limited to this method. Moreover, although a typical document in English and Japanese is shown below, the description of the inner structure by tagging is applicable to other languages as well.

For example, in a sentence "time flies like an arrow", tagging may be by <sentence> <noun phrase meaning="Time0"> time</noun phrase> <verb phrase> <verb meaning="fly1"> flies </verb> <adjective verb phrase> <adjective verb meaning="like0"> like </adjective verb> <noun phrase> an <noun meaning="arrow0"> arrow </noun> </noun phrase> </adjective phrase> </verb phrase<.</sentence>.

It is noted that <sentence>, <noun>, <noun phrase>, <verb>, <verb phrase>, <adjective verb> and <adjective verb phrase> denote a syntactic structure of a sentence, such as prepositional phrase, postpositional phrase/adjective phrase, or adjective phrase/adjective verb phrase, including the sentence, noun, noun phrase, verb, verb phrase and adjective, respectively. The tag is placed directly before the leading end of the element and directly after the end of the element. The tag placed directly below the element denotes the trailing end of the element by a symbol "/". The element means syntactic structural element, that is a phrase, a clause or a sentence. Meanwhile, the meaning (word sense)="time0" denotes the zeroth meaning of plural meanings, that is plural word senses, proper to the word "time". Specifically, the "time", which may be a noun or a verb, it is indicated that, here, it is noun. In addition, word "orange" has the meaning of at least the name or color of a plant or a fruit, which can be differentiated from one another by the meaning.

In the document processing apparatus, employing this document, the syntactic structure may be demonstrated on a window 101 of the display unit 31. In the window 101, the vocabulary elements are displayed in its right half 103, whilst the inner structure of the sentence is demonstrated in its left half 102. In this window 101, the syntactic structure may be demonstrated not only in the document expressed in Japanese, but also in documents expressed in optional other languages, inclusive of English.

Specifically, there is displayed, in the right half 103 of the window 101, a part of the following tagged document "A氏のB会が終わった市で、一部Cの大衆紙と一般紙がそ自主規制する方針を紙面で明らかにした。 (which reads: "In a city C, where a meeting B by Mr. A has finished, certain popular newspapers and high-brow newspapers clarified a guideline of voluntarily regulating photographic reports in their articles") is displayed. The following is typical tagging for this document:

<document> <sentence> <adjective phrase relation="place"> <noun phrase> <adjective verb phrase relation="C市"><adjective verb phrase relation="subject"> <noun phrase identifier="B会"> <adjective verb phrase relation="possession"> <personal name identifier="A氏"> A氏</personal name>の</adjective verb phrase> <name of an organization identifier="B会"> B会</name of an organization> </noun phrase>が</adjective verb phrase>終わった</adjective verb phrase> <place name identifier="C市">C市</place name> </noun phrase>で、</adjective verb phrase> <adjective verb phrase relation="subject"> <noun phrase identifier="newspaper" syntactic word="parallel"> <noun phrase> <adjective verb phrase>一部の</adjective verb phrase 大衆紙</noun phrase>と<noun>一般紙</noun> </noun phrase>が</adjective verb phrase> <adjective verb phrase relation="object"> </adjective verb phrase relation="contents" subject="newspaper"> <adjective verb phrase relation="object"> <noun phrase> <adjective verb phrase> <noun co-reference="B会">そ</noun> の</adjective verb phrase>写真報道</noun phrase> を</adjective verb phrase> 自主規制</adjective verb phrase> 方針を</adjective verb phrase> <adjective verb phrase relation="position"> 紙面で</adjective verb phrase> 明らかにした。</sentence> </document>

In the above document, "一部の大衆 紙と一般紙 reading: certain popular newspapers and certain high-brow newspapers" are represented as being parallel by a tag of a syntactic word="parallel". The parallel may be defined as having a modifying/modified relation. Failing any particular designation, <noun phrase relation="x"> <noun>A </noun> <noun>B <noun> </noun phrase> indicates that A is dependent on B.

The relation="x" denotes a relational attribute, which describe a reciprocal relation as to the syntactic word, meaning and modification. The grammatical functions, such as subject, object or indirect object, subjective roles, such as an actor, an actee or benefiting party and the modifying relation, such as reason or result, are stated by relational attributes. The relational attributes are represented in the form of relation=***. In the present embodiment the relational attributes are stated as to simpler grammatical functions, such as subject, object or indirect object.

In this document, attributes of the proper nouns, such as "A氏 "B会" and "C市" which read "Mr. A", "meeting B" and "city C", respectively, are stated by tags of e.g., place names, personal names or names of organizations. These tagged words, such as place names, personal names or names of organizations, are proper nouns.

The document processing apparatus is able to receive such tagged document. If a speech read-out program of the electronic document processing program, recorded on the ROM 15 or on the hard disc, is booted by the CPU 13, the document processing apparatus reads the document out through a series of steps shown in FIG. 4. Here, respective simplified steps are first explained, and respective steps are explained in detail, taking a typical document as examples.

Figure 4:
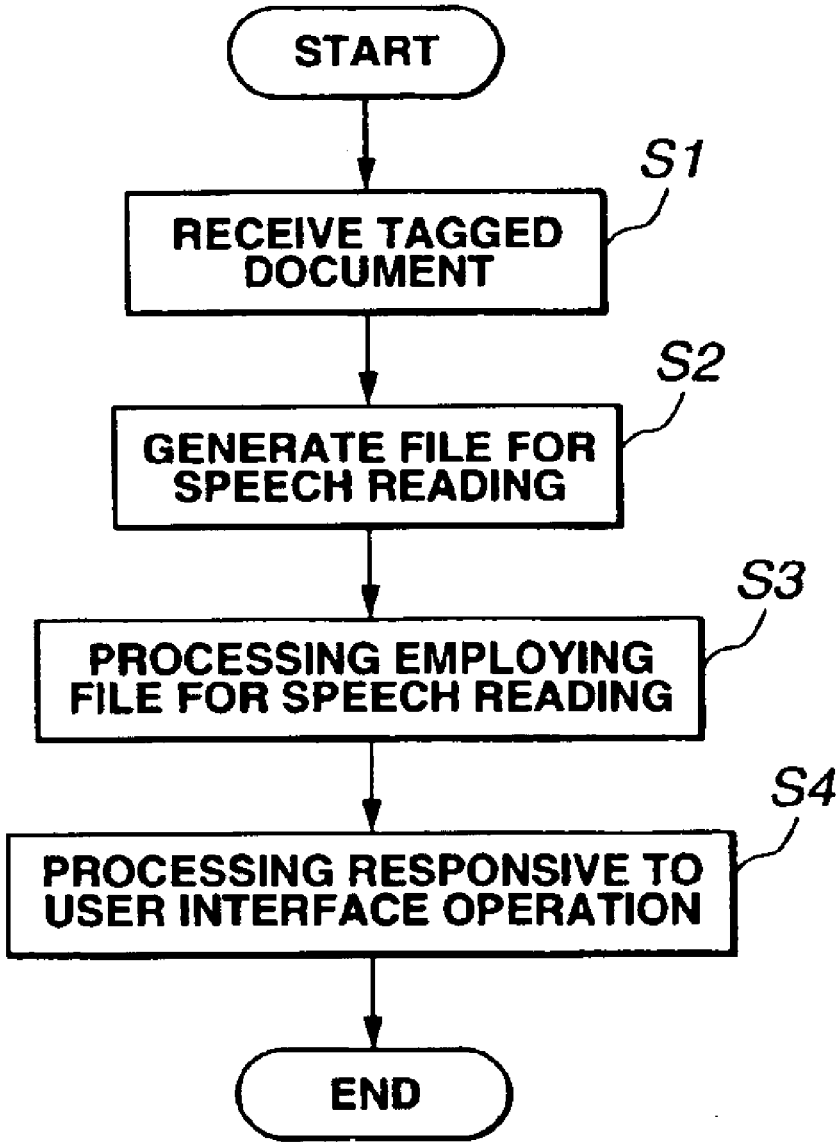
FIG. 4 is a flowchart for illustrating the sequence of processing operations in reading a document out.

First, the document processing apparatus receives a tagged document at step S1 in FIG. 4. Meanwhile, it is assumed that tags necessary for speech synthesis have been added to this document. The document processing apparatus is also able to receive a tagged document to add tags necessary to perform speech synthesis to the document to prepare a document. The document processing apparatus is also able to receive a non-tagged document to add tags inclusive of those necessary to effect speech synthesis to the document to prepare a tagged file. In the following, the tagged document, thus received or prepared, is termed a tagged file.

The document processing apparatus then generates, at step S2, a speech read-out file (read-out speech data) based on the tagged file, under control by the CPU 13. The read-out file is generated by deriving the attribute information for read-out from the tag in the tagged file, and by embedding the attribute information, as will be explained subsequently.

The document processing apparatus then at step S3 performs processing suited to the speech synthesis engine, using the speech read-out file, under control by the CPU 13.

The speech synthesis engine may be realized by hardware, or constructed by software. If the speech synthesis engine is to be realized by software, the corresponding application program is stored from the outset in the ROM 15 or on the hard disc of the document processing apparatus.

The document processing apparatus then performs the processing in keeping with operations performed by the user through a user interface which will be explained subsequently.

By such processing, the document processing apparatus is able to read out the given document on speech synthesis. The respective steps will now be explained in detail.

First, the reception or the formulation of the tagged document at step S1 is explained. The processing apparatus accesses the server 24 shown in FIG. 1, as discussed above, and receives a document as a result obtained on retrieval based on e.g., a keyword. The document processing apparatus receives the tagged document and newly adds tags required for speech synthesis to formulate a document. The document processing apparatus is also able to receive a non-tagged document and adds tags to the document including tags necessary for speech synthesis to prepare a tagged file.

Figure 5:
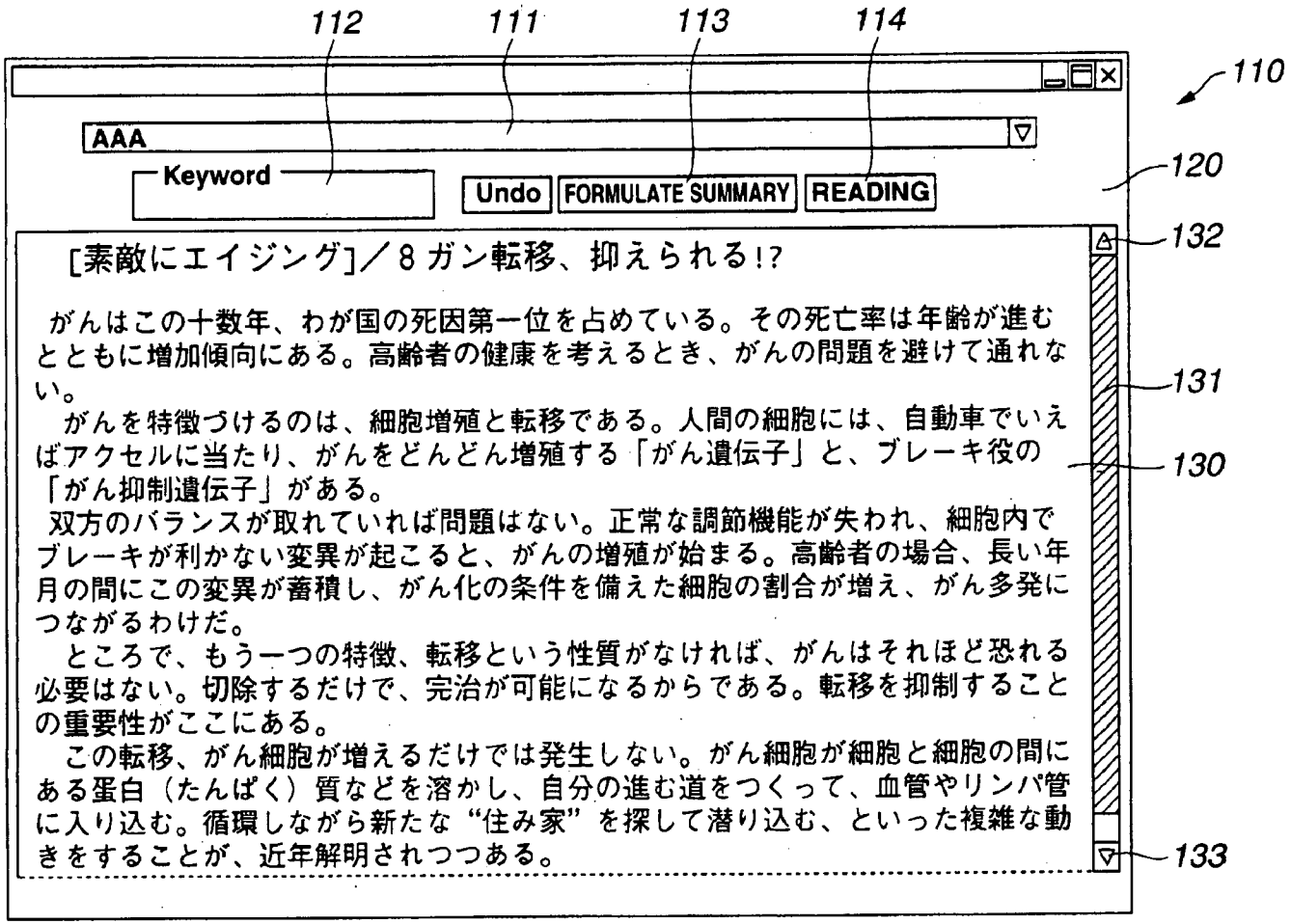
FIG. 5 shows a typical Japanese document received or formulated and specifically shows a window demonstrating a document.
Figure 6:
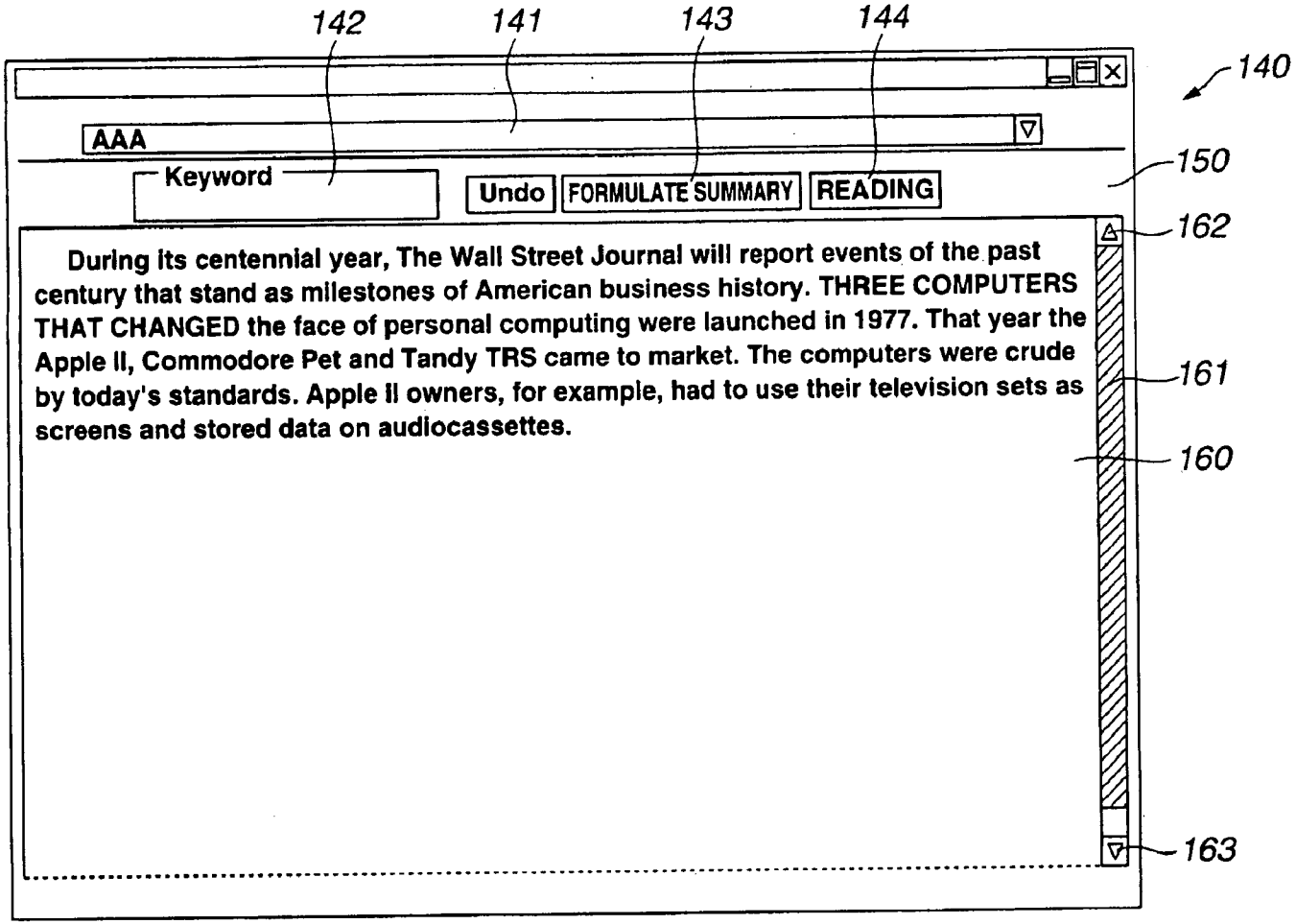
FIG. 6 shows a typical English document received or formulated and specifically shows a window demonstrating a document.

It is here assumed that a tagged file obtained on tagging a document in Japanese or in English shown in FIGS. 5 and 6 has been received or formulated. That is, the original document of the tagged file shown in FIG. 5 is the following document in Japanese:

“ 素敵にエイジングガン転移、抑えられる！？

がんはこの十数年、わが国の死因第一位を占めている。その死亡率は年齢が進むとともに増加傾向にある。高齢者の健康を考えるとき、がんの問題を避けて通れない。がんを特徴づけるのは、細胞増殖と転移である。人間の細胞には、自動車でいえばアクセルに当たり、がんをどんどん増殖するがん遺伝子と、ブレーキ役のがん抑制遺伝子がある。双方のバランスが取れていれば問題はない。正常な調節機能が失われ、細胞内でブレーキが利かなくなれば、がんはそれほど恐れる必要はない。細胞内でブレーキが利かない変異が起こると、がんの増殖が始まる。高齢者の場合、長い年月の間にこの変異が蓄積し、がん化の条件を備えた細胞の割合が増え、がん多発につながるわけだ。ところで、もう一つの特徴、転移と切除するだけで、完治が可能ることの重要性がここにある。この転移、がん細胞が増えるだけでは発生しない。細胞と細胞の間にある蛋白たんぱく質などを溶かし、自分の進む道をつくって、血管やリンパ管に入り込む。循環しながら新たな住み家を探して潜り込む、といった複雑な動きをすることが、近年解明されつつある。

The above Japanese text reads in English context as follows: “[Aging Wonderfully]/8 is cancer transposition suppressible?]

In the last ten or more years, cancer ranks first among the causes of mortality in this country. The rate of mortality tends to be increased as the age progresses. If the health of the aged is to be made much of, the problem of cancer cannot be overlooked.

What characterizes the cancer is cell multiplication and transposition. Among cells of the human being, there are cancer genes simulated to an accelerator in a vehicle and which are responsible for cancer multiplication and cancer suppressing genes simulated to a brake in the vehicle.

If these two are balanced to each other, no problem arises. If the normal adjustment mechanism is lost, such that changes that cannot be braked occur in the cells, cancer multiplication begins. With the aged people, this change is accumulated with time, and the proportion of the cells disposed to transition to cancer is increased to cause cancer.

Meanwhile, if it were not for another feature, that is transposition, the cancer is not so dreadful, because mere dissection leads to complete curing. Here lies the importance of suppressing the transposition.

This transposition is not produced simply due to multiplication of cancer cells. The cancer cells dissolve the protein between the cells to find their way to intrude into the blood vessel or lymphatic vessel. It has recently discovered that the cancer cells perform complex movements of searching for new abodes as they are circulated to intrude into the so-found-out abodes”.

On receipt of this Japanese text, the document processing apparatus demonstrates the document in the window 110 in the display unit 31. The window 110 is divided into a display area 120, in which are demonstrated the document name display unit 111, a key word input unit 112, into which the keyword is input, a summary preparation execution button 113, as an executing button for creating a summary text of the document, as later explained, and a read-out executing button 114 for executing reading out, and a document display area 130. On the right end of the document display area 130 are provided a scroll bar 131 and buttons 132, 133 for vertically moving the scroll bar 131. If the user directly moves the scroll bar 131 in the up-and-down direction, using the mouse of e.g., the input unit 20, or thrusts the buttons 132, 133 to move the scroll bar 131 vertically, the display contents on the document display area 130 can be scrolled vertically.

On the other hand, the original document of the tagged file shown in FIG. 6 is the following document in English:

“During its centennial year, The Wall Street Journal will report events of the past century that stand out as milestones of American business history. THREE COMPUTERS THAT CHANGED the face of the personal computing were launched in 1977. That year the Apple II, Commodore Pet and Yandy TRS came to market. The computers were crude by to-day’s standards. Apple II owners, for example, had to use their television sets as screens and stored data on audiocassettes.”

On receipt of this English document, the document processing apparatus displays the document in the window 140 demonstrated on the display unit 31. Similarly to the window 110, the window 140 is divided into a display area 150 for displaying a document name display portion 141, for demonstrating the document name, a key word input portion 142 for inputting the key word, a summary text creating button 143, as an execution button for preparing the summary text of the document, and a read-out execution button 144, as an execution button for reading out, and a document display area 160. On the right end of the document display area 160 are provided a scroll bar 161 and buttons 162, 163 for vertically moving the scroll bar 161. If the user directly moves the scroll bar 161 in the up-and-down direction, using the mouse of e.g., the input unit 20, or thrusts the buttons 162, 163 to move the scroll bar 161 vertically, the display contents on the document display area 160 can be scrolled vertically.

The documents in Japanese and in English, shown in FIGS. 5 and 6, respectively, are formed as tagged files shown in FIGS. 7 and 8, respectively.

FIG. 7A shows the heading portion "素敵にエイジングガン転移、抑えられる ?" which reads: "[Aging Wonderfully]/8 is cancer transposition suppressible?]" extracted from the Japanese document. On the other hand, the tagged file shown in FIG. 7B shows the last paragraph of the document "この転移、がん細胞が増えるだけでは発生しない。がん細胞が細胞と細胞の間にある蛋白質などを溶かし、自分の進む道をつくって、血管やリンパ管に入り込む。循環しながら新たな住み家を探して潜り込む、といった複雑な動きをすることが、近年解明されつつある。 which reads: "This transposition is not produced simply due to multiplication of cancer cells. The cancer cells dissolve the protein between the cells to find their way to intrude into the blood vessel or lymphatic vessel. It has recently discovered that the cancer cells perform complex movements of searching for new abodes as they are circulated to intrude into the so-found-out abodes", as extracted from the same document, with the remaining paragraphs being omitted. It is noted that the real tagged file is constructed as one file from the heading portion to the last paragraph.

In the heading portion, shown in FIG. 7A, the <heading> indicates that this portion is the heading. To the last paragraph, shown in FIG. 7B, a tag indicating that the relational attribute is "condition" or "means" is added. The last paragraph shown in FIG. 7B shows an example of a tag necessary to effect the above-mentioned speech synthesis.

Among the tags necessary for speech synthesis, there is such tag which is added when the information indicating the pronunciation (Japanese hiragana letters to indicate the pronunciation) is added to the original document, as in the casse of "蛋白 (protein, uttered as "tanpaku") (たんぱく (uttered as "tanpaku"))". In this case, the reading attribute information, that is pronunciation="null" is added to prevent duplicated reading of "たんぱく たんぱく (uttered as "tanpaku tanpaku")", that is, a tag inhibiting the reading out of the "(たんぱく (uttered as "tanpaku"))" is added. For this tag, there is also shown the information that it has a special function.

Among the tags necessary for speech synthesis, there are such a tag added to a specialized term, such as "リンパ管 (lymphatic vessel, uttered as "rinpa-kan")", or to a word difficult to pronounce, and which is liable to be mis-pronounced, such as "住み家 (abode, uttered as "sumika")". That is, in the present case, the reading attribute information showing the pronunciation (Japanese hiragana letters to indicate the pronunciation), that is the pronunciation=りんぱかん (uttered as "rinpa-kan")" or the pronunciation=すみか (uttered as "sumika")", in order to prevent the mis-reading of "りんぱくだ (uttered as "rinpa-kuda")" or すみいえ (uttered as "sumi-ie")", is used.

On the other hand, there is added the tag indicating that the sentence is a complement sentence or that plural sentences are formed in succession to form a sole sentence. As the tag necessary to effect speech synthesis in this tagged file, the reading attribute information of the pronunciation="two" is stated for the roman figure of II. This reading attribute information is stated to prevent the misreading of セカンド (uttered as "second")" when it is desirable that II be read トゥ (uttered as "two")".

If a citation is included in a document, there is added a tag indicating that the sentence is a citation, although such tag is not shown. Moreover, if an interrogative sentence is included in a document, a tag, not shown, indicating that the sentence is an interrogative sentence, is added to the tagged file.

The document processing apparatus receives or prepares the document, having added thereto a tag necessary for speech synthesis, at step S1 in FIG. 4.

The generation of the speech read-out file at step S2 is explained. The document processing apparatus derives the attribute information for reading out, from the tags of the tagged file, and embeds the attribute information, to prepare the speech read-out file.

Specifically, the document processing apparatus finds out tags indicating the beginning locations of the paragraphs, sentences and phrases of the document, and embeds the attribute information for reading out in keeping with these tags. If the summary text of the document has been prepared, as later explained, it is also possible for the document processing apparatus to find out the beginning location of the summary text from the document to embed the attribute information indicating enhancing the sound volume in reading out the document to emphasize that the portion being read is the summary text.

From the tagged file, shown in FIG. 7 or 8, the document processing apparatus generates a speech read-out file. Meanwhile, the speech read-out file, shown in FIG. 9A, corresponds to the extract of the heading shown in FIG. 7A, while the speech read-out file shown in FIG. 9B corresponds to the extract of the last paragraph shown in FIG. 7B. Of course, the actual speech read-out file is constructed as a sole file from the header portion to the last paragraph.

In the speech read-out file shown in FIG. 9A, there is embedded the attribute information of Com:=Lang=***, in keeping with the beginning portion of the document. This attribute information denotes the language with which a document is formed. Here, the attribute information is Com:=Lang=JPN, indicating that the language of the document is Japanese. In the document processing apparatus, this attribute information may be referenced to select the proper speech synthesis engine conforming to the language from one document to another.

Moreover, in the speech read-out file shown in FIGS. 9A and 9B, there is embedded the attribute information of Com:=begin_p, Com:=begin_s, and Com:=begin_ph. These attribute information denotes the beginning portions of the paragraph, sentence and the phrase of the document, respectively. Based on the tags in the above-mentioned tagged file, the document processing apparatus detects at least two beginning positions of the paragraphs, sentences and the phrases. If, in the speech read-out file, tags indicating the syntactic structure of the same level appear in succession, as in the case of the <adjective verb phrase> and <noun phrase>, in the above-mentioned tagged file, respective corresponding numbers of the Com:=begin_ph are not embedded, but are collected and a sole Com:=begin_ph is embedded.

Also, in the speech read-out file, there is embedded the attribute information of Pau=00, Pau=100 and Pau=50 in keeping with Com:=begin_p, Com:=begin_s, and Com:=begin_ph, respectively. These attribute information indicate that pause periods of 500 msec, 100 msec and 50 msec are to be provided in reading out the document. That is, the document processing apparatus reads the document out by the speech synthesis engine by providing pause periods of 500 msec, 100 msec and 50 msec at the beginning portions of the paragraphs, sentences and phrases of the document, respectively. Meanwhile, these attribute information are embedded in association with the Com:=begin_p, Com:=begin_s, and Com:=begin_ph. So, the portion of the tagged file where the tags indicating the syntactic structure of the same level appear in succession, as in the case of the <adjective verb phrase> and <noun phrase>, is handled as being a sole phrase such that a sole Pau=50 is embedded without a corresponding number of the Pau=50s being embedded. The portions of the document where tags indicating the syntactic structure of different levels appear in succession, as in the case of the <paragraph>, <sentence> and <noun phrase> in the tagged file, respective corresponding Pau=***s are embedded. So, the document processing apparatus reads out the document portion with a pause period of 650 msec corresponding to the sum of the respective pause periods for the paragraph, sentence and the phrase of the document. Thus, with the document processing apparatus, it is possible to provide pause periods corresponding to the paragraph, sentence and the phrase so that the length will be shorter in the sequence of the paragraph, sentence and the phrase to realize the reading out free of an extraneous feeling by taking the interruptions in the paragraph, sentence and the phrase into account. Meanwhile, the pause period can be suitably changed, it being unnecessary for the pause periods at the beginning portions of the paragraph, sentence and the phrase of the document to be 500 msec, 100 msec and 50 msec, respectively.

In addition, in the speech read-out file shown in FIG. 9B, "たんぱく (uttered as "tan-paku"))" is removed in association with the reading attribute information of the pronunciation="null" stated in the tagged file, whilst the "リンパ管 (lymphatic vessel, uttered as "rinpa-kan")" and 住み家 (abode, uttered as "sumika")" are replaced by "りんぱかん (uttered as "rinpa-kan")" and すみか (uttered as "sumika")", respectively, in keeping with the reading attribute information of pronunciation="りんぱかん (uttered as "rinpa-kan")" and the reading attribute information of pronunciation="すみか (uttered "as sumika")", respectively. The document processing apparatus, embedding this reading attribute information, is not liable to make a reading error due to defects in the dictionary referenced by the speech synthesis engine.

In the speech read-out file, the attribute information for specifying only a citation to use another speech synthesis engine based on the tag indicating that the portion of the document is the citation comprehended in the document.

Moreover, the attribute information for intoning the terminating portion of the sentence based on the tag indicating that the sentence is an interrogative sentence may be embedded in the speech read-out file.

The attribute information for converting the bookish style by so-called "である調 ('is')" into more colloquial style by "ですます調 (again 'is' in English context)" as necessary may be embedded in the speech read-out file. In this case, it is also possible to convert the bookish style sentence into colloquial style sentence to generate the speech read-out file instead of embedding the attribute information in the speech read-out file.

On the other hand, there is embedded the attribute information Com=Lang=ENG at the beginning portion of the document in the speech read-out file shown in FIG. 10, indicating that the language with which the document is stated is English.

In the speech read-out file is embedded the attribute information Com=Vol=* denoting the sound volume in reading the document out. For example, Com=Vol=0 indicates reading out with the default sound volume of the document processing apparatus. Com=Vol=80 denotes that the document is to be read out with the sound volume raised by 80% from the default sound volume. Meanwhile, optional Com=Vol=* is valid until the next Com=Vol=***.

Moreover, in the speech read-out file, [II] is replaced by [two] in association with the reading a of pronunciation="two" stated in the tagged file.

Figure 11:
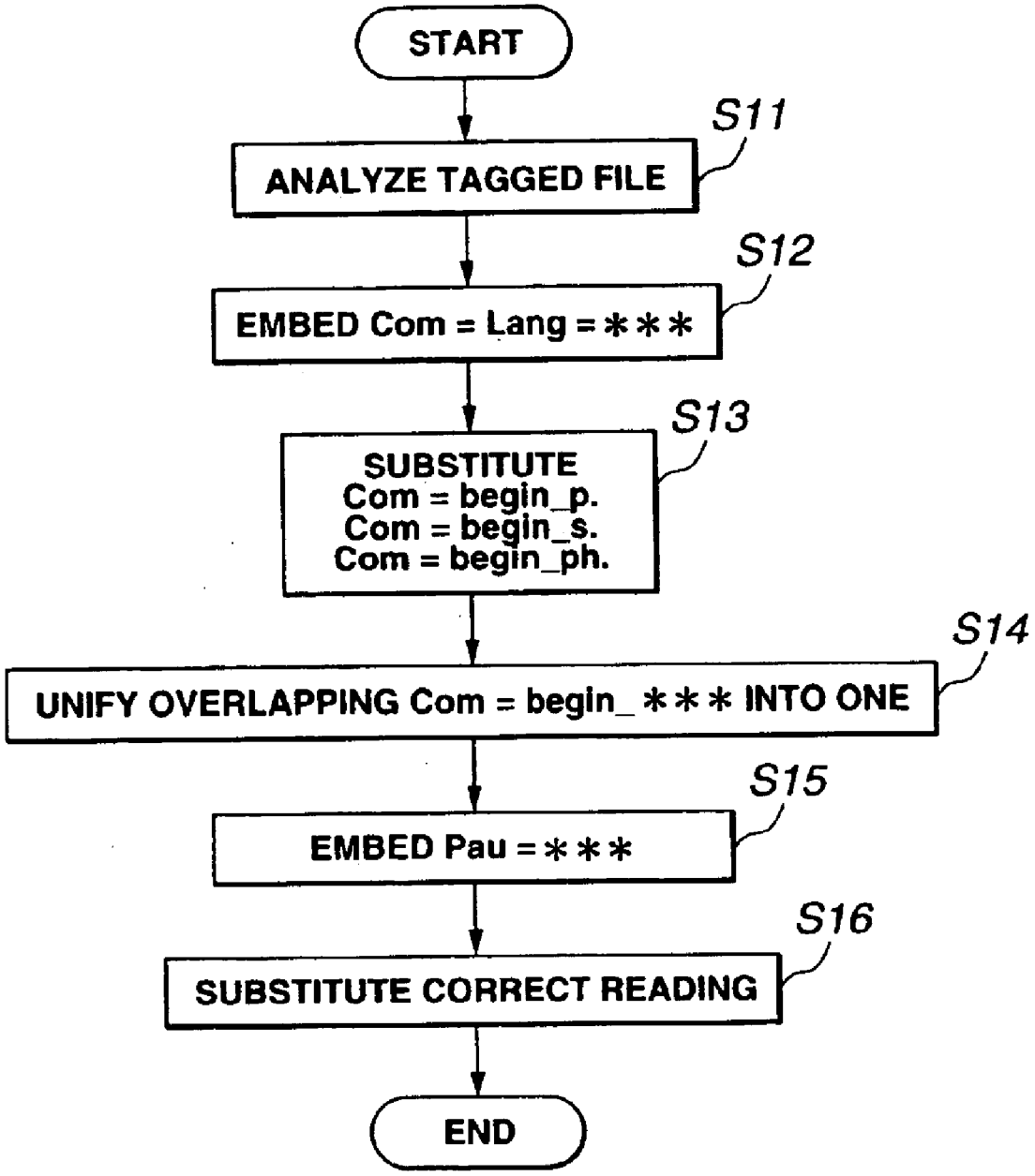
FIG. 11 is a flowchart for illustrating the sequence of operations in generating the speech reading file.

The document processing apparatus generates the above-described speech read-out file through the sequence of steps shown in FIG. 11.

First, the document processing apparatus at step S11 analyzes the tagged file, received or formulated, as shown in FIG. 11. The document processing apparatus checks the language with which the document is formulated, while searching the paragraphs in the document, beginning portions of the sentence and the phrases, and the reading attribute information, based on tags.

The document processing apparatus at step S12 embeds Com=Lang=* at the document beginning portion, by the CPU 13**, depending on the language with which the document is formulated.

The document processing apparatus then substitutes the attribute information in the speech read-out file by the CPU 13 for the beginning portions of the paragraphs, sentences and phrases of the document. That is, the document processing apparatus substitutes Com=begin_p, Com=begin_s and Com=begin_ph for the <paragraph>, <sentence> and <***phrase> in the tag file, respectively.

The document processing apparatus then unifies at step S14 the same Com=begin_* overlapping due to the same level syntactic structure into the sole Com=begin_* by the CPU 13.

The document processing apparatus then embeds at step S15 Pau=* in association with Com=begin_* by the CPU 13. That is, the document processing apparatus embeds Pau=500 directly before Com=begin_p, while embedding Pau=100 and Pau=50 directly before Com=begin_s and Com=begin_ph, respectively.

At step S16, the document processing apparatus substitutes correct reading by the CPU 13 based on the reading attribute information. That is, the document processing apparatus removes "たんぱく (uttered as "tan-paku"))" based on the reading attribute information of pronunciation="null", while substituting りんぱかん (uttered as "rinpa-kan")" and "すみか (uttered as "sumika")" for the "リンパ管 (lymphatic vessel, uttered as "rinpa-kan")" and for the "住み家 (abode, uttered as "sumika")", based on the reading attribute information of the pronunciation="りんぱかん (uttered as "rinpa-kan")" and on the reading attribute information of the pronunciation="すみか (uttered as "sumika")".

At step S2 shown in FIG. 4, the document processing apparatus performs the processing shown in FIG. 1 to generate the speech read-out file automatically. The document processing apparatus causes the speech read-out file so generated in the RAM 14.

The processing for employing the speech read-out file at step S3 in FIG. 4 is explained. Using the speech read-out file, the document processing apparatus performs processing suited to the speech synthesis engine pre-stored in the ROM 15 or in the hard disc under control by the CPU 13.

Specifically, the document processing apparatus selects the speech synthesis engine used based on the attribute information Com=Lang=*** embedded in the speech read-out file. The speech synthesis engine has identifiers added in keeping with the language or with the distinction between male and female speech. The corresponding information is recorded as e.g., initial setting file on a hard disc. The document processing apparatus references the initial setting file to select the speech synthesis engine of the identifier associated with the language.

The document processing apparatus also converts the Com=begin_***, embedded in the speech read-out file, into a form suited to the speech synthesis engine. For example, the document processing apparatus marks the Com=begin_p with a number of the order of hundreds such as by Mark=100, while marking the Com=begin_s with a number of the order, of thousands such as by Mark=1000 and marking the Com=begin_s with a number of the order of ten thousands such as by Mark=10000.

Since the attribute information for the sound volume is represented by percent of the increase to the default sound volume, such as by Vol=***, the document processing apparatus finds the sound volume on conversion of the percent information into the absolute value information based on this attribute information.

By performing the processing employing the speech read-out file at step S3 in FIG. 4, the document processing apparatus converts the speech read-out file into a form which permits the speech synthesis engine to read out the speech read-out file.

The operation employing the user interface at step S4 in FIG. 4 is now explained. The document processing apparatus acts on e.g., a mouse of the input unit 20 to thrust the read-out executing button 114 or read-out execution button 144 shown in FIGS. 5 and 6 to boot the speech synthesis engine. The document processing apparatus causes a user interface window 170 shown in FIG. 12 to be demonstrated on the display unit 31.

Figure 12:
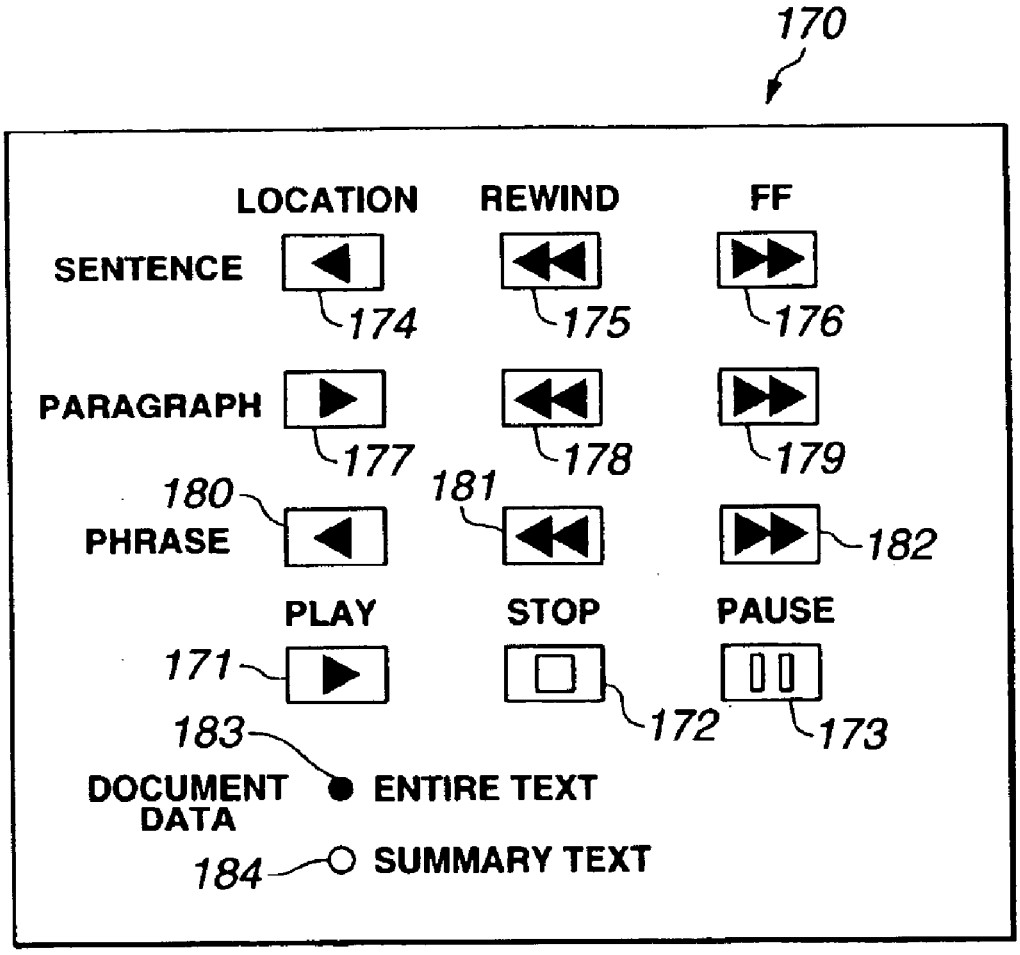
FIG. 12 shows a user interface window.

The user interface window 170 includes a replay button 171 for reading out the document, a stop button 172 for stopping the reading and a pause button 173 for transiently stopping the reading, as shown in FIG. 12. The user interface window 170 also includes a button for locating including rewind and fast feed. Specifically, the user interface window 170 includes a locating button 174, a rewind button 175 and a fast feed button 176 for locate, rewind and fast feed on the sentence basis, a locating button 177, a rewind button 178 and a fast feed button 179 for locate, rewind and fast feed on the paragraph basis, and, a locating button 180, a rewind button 181 and a fast feed button 182 for locate, rewind and fast feed on the phrase basis. The user interface window 170 also includes selection switches 183, 184 for selecting whether the object to be read is to be the entire text or a summary text prepared as will be explained subsequently. Meanwhile, the user interface window 170 may include a button for increasing or decreasing the sound volume, a button for increasing or decreasing the read out rate, a button for changing the voice of the male/female speech, and so on.

The document processing apparatus performs the operation of reading out by the speech synthesis engine by the user acting on the various buttons/switches by thrusting/selecting e.g., the mouse of the input unit 20. For example, if the user thrusts the replay button 171 to start reading the document out, whereas, if the user thrusts the locating button 174 during reading, the document processing apparatus jumps to the start position of the sentence currently read out to re-start reading. By the marking made st step S3 in FIG. 4, the document processing apparatus is able to make mark-based jump when reading out. That is, if the user thrusts the rewind button 178 or the fast button 179, using e.g., the mouse of the input unit 20, the document processing apparatus discriminates only marks indicating the start position of the paragraph for the number of the order of hundreds, such as Mark=100, to make the jump. In a similar manner, if the user thrusts the rewind button 175, fast feed button 176, rewind button 181 and the fast feed button 182, using e.g., the mouse of the input unit 20, the document processing apparatus discriminates only the marks indicating the beginning positions of the sentences and phrases having the numbers of the orders of thousands and ten thousands, such as Mark=1000 or Mark=10000, to make a jump. Thus, the document processing apparatus makes a jump based on the paragraph or phrase basis at the time of reading out the document to respond to the request such as the request for repeated replay of the document portion desired by the user.

The document processing apparatus causes the speech synthesis engine to read out the document by the user performing the processing employing the user interface at step S4. The information thus read out is output from the speech output unit 30.

In this manner, the document processing apparatus is able to read the desired document by the speech synthesis engine without extraneous feeling.

The reading out processing in case the summary text is formulated is now explained. Here, the processing of formulating the summary text from the tagged document is explained with reference to FIGS. 13 to 21.

If a document is to be prepared in the document processing apparatus, the user acts on the input unit 20, as the document is displayed on the display unit 31, to command execution of the automatic summary creating mode. That is, the document processing apparatus drives the hard disc drive 34, under control by the CPU 13, to boot the automatic summary creating mode of the electronic document processing program stored in the hard disc. The document processing apparatus controls the display unit 31 by the CPU 13 to demonstrate an initial picture for the automatic document processing program shown in FIG. 13. The window 190, demonstrated on the display unit 31, is divided into a display area 200 for displaying a document name display portion 191, for demonstrating the document name, a key word input portion 192 for inputting a key word, and a summary text creating button 193, as an execution button for preparing the summary text of the document, a document display area 210 and a document summary text display area 220.

In the document name display portion 191 of the display area 200 is demonstrated the name etc., of the document demonstrated on the display area 210. In the key word input portion 192 is input a keyword for preparing the summary text of the document using e.g., a key word for formulating the document. The summary text creating button 193 is a button for starting the processing of formulating the summary of the document demonstrated on the display area 210 on pushing e.g., a mouse of the input unit 20.

In the display area 210 is demonstrated the document. On the right end of the document display area 210 are provided a scroll bar 211 and buttons 212, 213 for vertically moving the scroll bar 211. If the user directly moves the scroll bar 211 in the up-and-down direction, using the mouse of e.g., the input unit 20, or thrusts the buttons 212, 213 to move the scroll bar 211 vertically, the display contents on the document display area 210 can be scrolled vertically. The user is also able to act on the input unit 20 to select a portion of the document demonstrated on the display area 210 to formulate a summary or a summary of the entire text.

In the display area 220 is demonstrated the summary text. Since the summary text has as yet not been formulated, nothing is demonstrated in FIG. 13 on the display area 220. The user may act on the input unit 20 to change the display area (size) of the display area 220. Specifically, the user may enlarge the display area (size) of the display area 220, as shown for example in FIG. 14.

Figure 15:
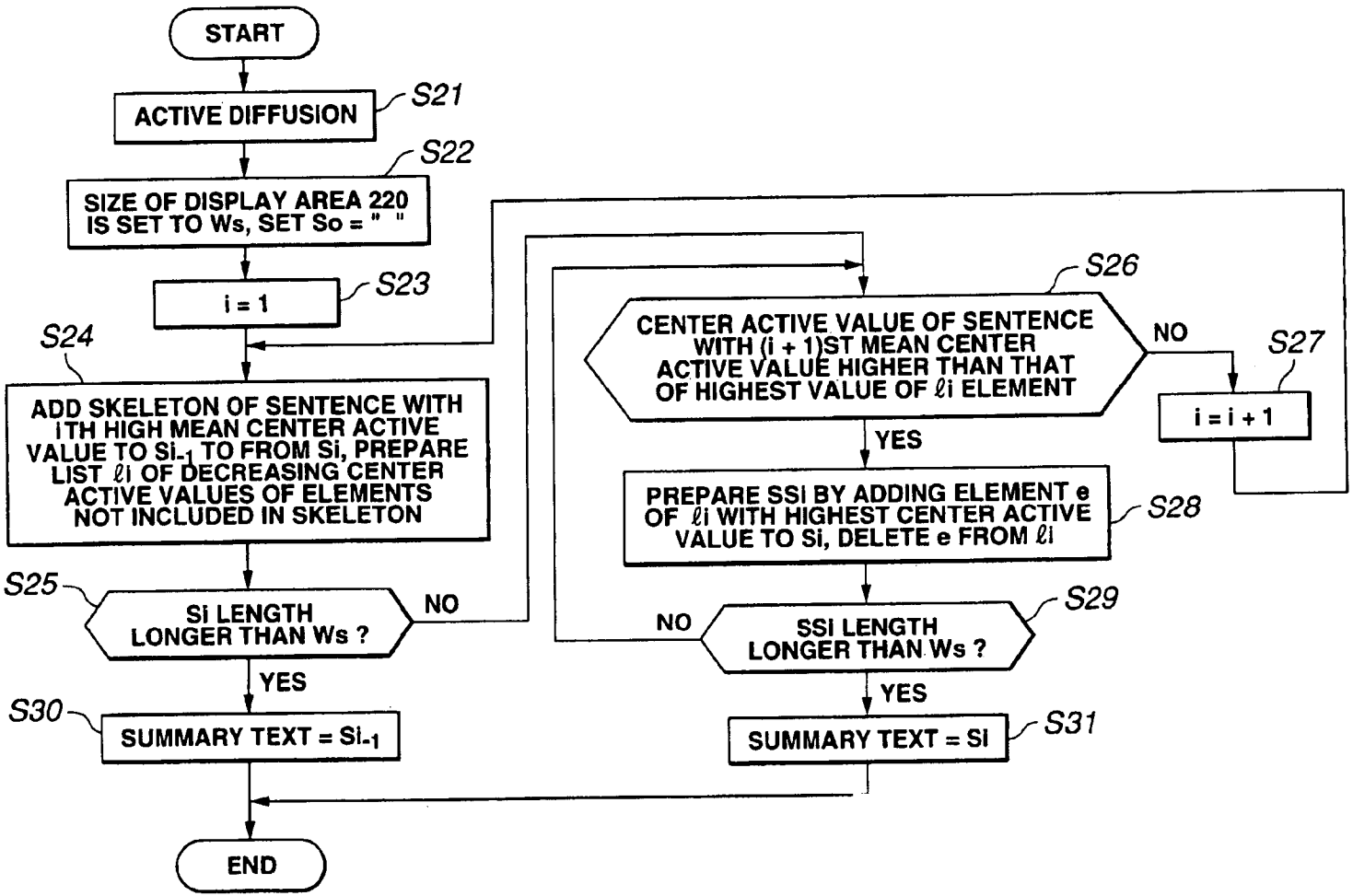
FIG. 15 is a flowchart for illustrating a sequence of processing operations in preparing a summary text.

If the user pushes the summary text creating button 193, using e.g., a mouse of the input unit 20, to set an on-state, the document processing apparatus executes the processing shown in FIG. 15 to start the preparation of the summary text, under control by the CPU 13.

Figure 14:
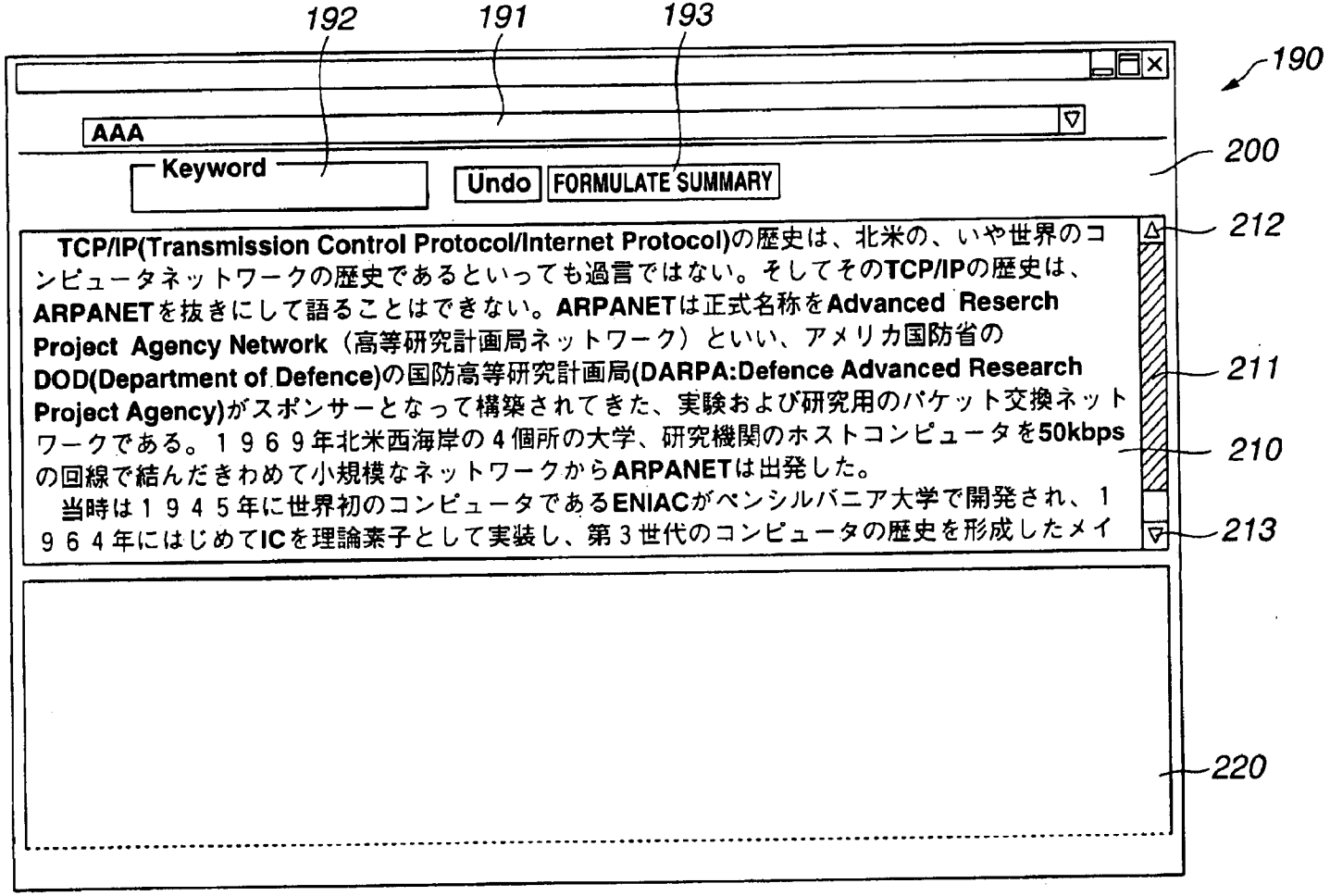
FIG. 14 shows a window demonstrating a document and particularly showing a summary text demonstrating display area enlarged as compared to a display area shown in FIG. 13.

The processing for creating the summary text from the document is executed on the basis of the tagging pertinent to the inner document structure. In the document processing apparatus, the size of the display area 220 of the window 190 can be changed, as shown in FIG. 14. If, after the window 190 is newly drawn on the display unit 31, under control by the CPU 13, or the size of the display area 220 is changed, the summary text creating button 193 is thrust, the document processing apparatus executes the processing of preparing the summary text, from the document at least partially demonstrated on the display area 210 of the window 190, so that the summary text will fit in the display area 220.

First, the document processing apparatus performs, at step S21, the processing termed active diffusion, under control by the CPU 13. In the present embodiment, the summary text of the document is prepared by adopting a center active value, obtained by the active diffusion, as the degree of criticality. That is, in the document tagged with respect to its inner structure, each element may be added by this active diffusion with a center active value corresponding to tagging pertinent to its inner structure.

The active diffusion is the processing of adding the maximum center active value even to elements pertinent to elements having high center active values. Specifically, in active diffusion, the center active value is equal between an element represented in anaphora (co-reference) and its antecedent, with each center active value converging to the same value otherwise. Since the center active value is determined responsive to the tagging pertinent to the inner document structure, the center active value can be exploited for document analyses which takes the inner document structure into account.

Figure 16:
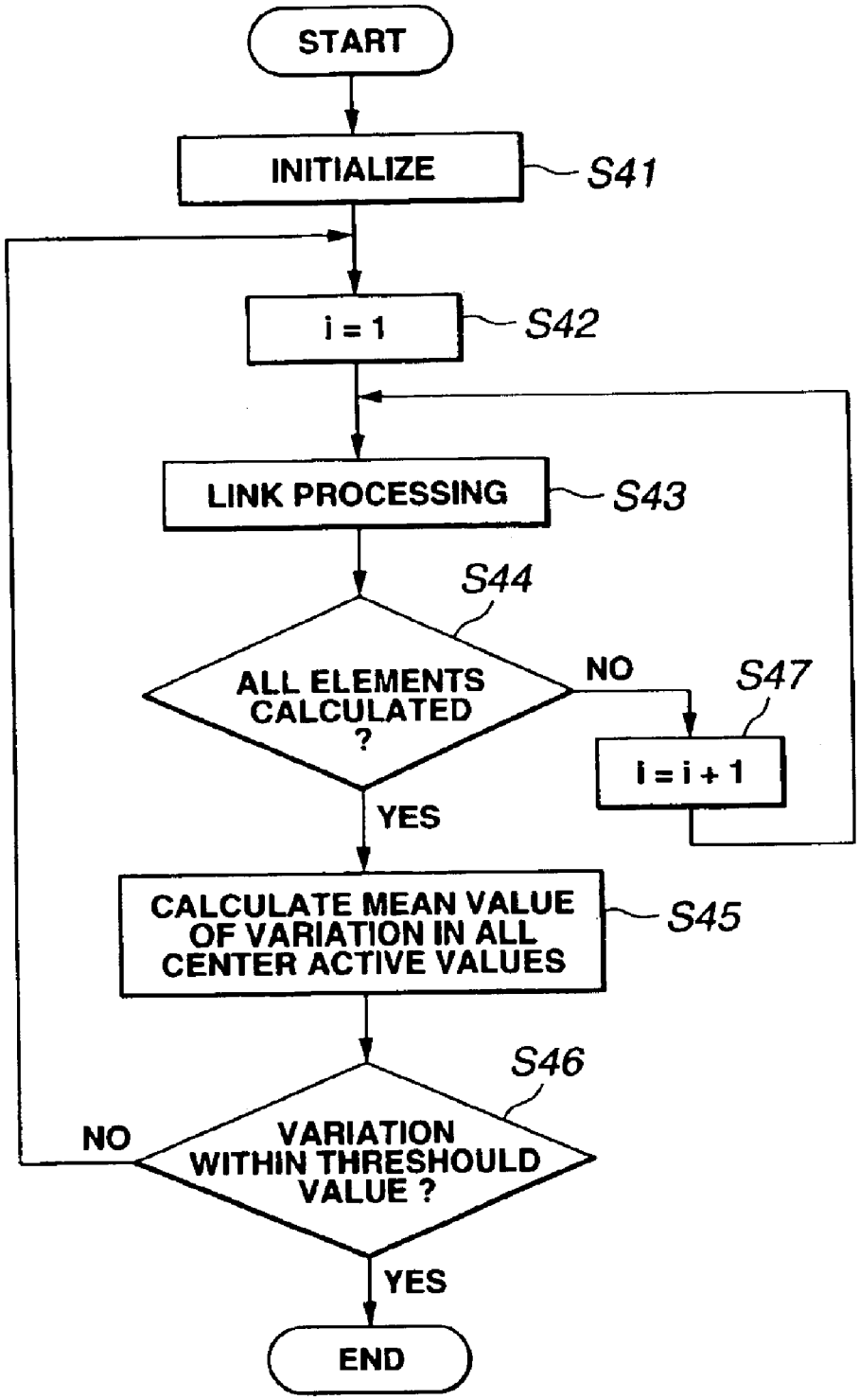
FIG. 16 is a flowchart for illustrating a sequence of processing operations in executing active diffusion.

The document processing apparatus executes active diffusion by a sequence of steps shown in FIG. 16.

The document processing apparatus first initializes each element, at step S41, under control by the CPU 13, as shown in FIG. 16. The document processing apparatus allocates an initial center active value to each of the totality of elements excluding the vocabulary elements and to each of the vocabulary elements. For example, the document processing apparatus allocates "1" and "0", as the initial center active values, to each of the totality of elements excluding the vocabulary elements and to each of the vocabulary elements. The document processing apparatus is also able to allocate a non-uniform value as the initial center active value of each element at the outset to get the offset in the initial value reflected in the center active value obtained on active diffusion. For example, in the document processing apparatus, a higher initial center active value may be set for elements in which the user is interested to achieve the center active value which reflects the user's interest.

As for the referencing/referenced link, as a link having the modifying/modified relation by the referencing/referenced relation between elements, and normal links, as other links, a terminal point active value at terminal points of the link interconnecting the elements is set to "0". The document processing apparatus causes the initial terminal point active value, thus added, to be stored in the RAM 14.

Figure 17:
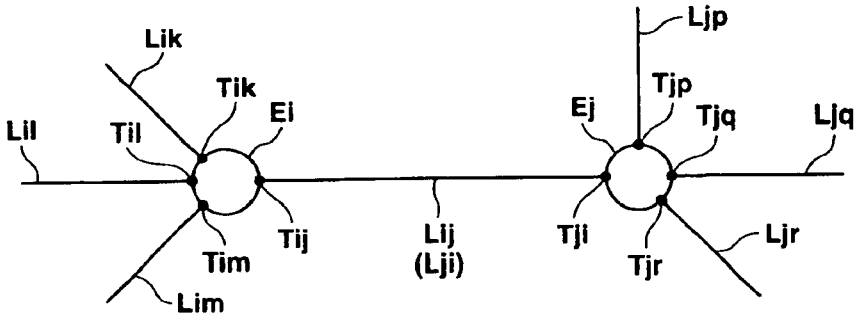
FIG. 17 illustrates an element linking structure for illustrating the processing for active diffusion.

A typical element-to-element connecting structure is shown in FIG. 17, in which an element $E_i$ and an element $E_j$ as part of the structure of the element and the link making up a document. The element $E_i$ and the element $E_j$, having center active values of $e_i$ and $e_j$, respectively, are interconnected by a link $L_{ij}$. The terminal points of the link $L_{ij}$ connecting to the element $E_i$ and to the element $E_i$ are $T_{ij}$ and $T_{ji}$, respectively. The element $E_i$ is connected to elements $E_k$, $E_l$ and $E_m$, not shown, through links $L_{ik}$, $L_{il}$ and $Li_{im}$, respectively, in addition of to the element $E_j$ connected over the link $L_{ij}$. The element $E_j$ is connected to elements $E_p$, $E_q$ and Er, not shown, through links $L_{ip}$, $L_{jq}$ and $L_{jr}$, respectively, in addition of to the element $E_i$ connected over the link $L_{ji}$.

The document processing apparatus then at step S42 of FIG. 16 initializes a counter adapted for counting the element $E_i$ of the document, under control by the CPU 13. That is, the document processing apparatus sets the count value i of the element counting counter to "1". So, the counter references the first element $E_i$.

The document processing apparatus at step S43 then executes the link processing of newly counting the center active value of the elements referenced by the counter, under control by the CPU 13. This link processing will be explained later in detail.

At step S44, the document processing apparatus checks, under control by the CPU 13, whether or not new center active values of the totality of elements in the document have been computed.

If the document processing apparatus has verified that the new center active values of the totality of elements in the document have been computed, the document processing apparatus transfers to the processing at step S45. If the document processing apparatus has verified that the new center active values of the totality of elements in the document have not been computed, the document processing apparatus transfers to the processing at step S47.

Specifically, the document processing apparatus verifies, under control by the CPU 13, whether or not the count value i of the counter has reached the total number of the elements included in the document. If the document processing apparatus has verified that the count value i of the counter has reached the total number of the elements included in the document, the document processing apparatus proceeds to step S45, on the assumption that the totality of the elements have been computed. If conversely the document processing apparatus has verified that the count value i of the counter has not reached the total number of the elements included in the document, the document processing apparatus proceeds to step S47, on the assumption that the totality of the elements have not been computed.

If the document processing apparatus has verified that the count value i of the counter has not reached the total number of the elements making up the document, the document processing apparatus at step S47 causes the count value i of the counter to be incremented by "1" to set the count value of the counter to "i+1". The counter then references the i+1st element, that is the next element. The document processing apparatus then proceeds to the processing at step S43 where the calculation of terminal point active value and the next following sequence of operations are performed on the next i+1st element.

If the document processing apparatus has verified that the count value i of the counter has reached the total number of the elements making up the document, the document processing apparatus at step S45 computes an average value of the variants of the center active values of the totality of the elements included in the document, that is an average value of the variants of the newly calculated center active values with respect to the original center active values.

The document processing apparatus reads out the original center active values memorized in the RAM 14 and the newly calculated center active values with respect to the totality of the elements making up the document, under control by the CPU 13. The document processing apparatus divides the sum of the variants of the newly calculated center active values with respect to the original center active values by the total number of the elements contained in the document to find an average value of the variants of the center active values of the totality of the elements. The document processing apparatus also causes the co-calculated average value of the variants of the center active values of the totality of the elements to be stored im e.g., the RAM 14.

The document processing apparatus at step S46 verifies, under control by the CPU 13, whether or not the average value of the variants of the center active values of the totality of the elements, calculated at step S45, is within a pre-set threshold value. On the other hand, if the document processing apparatus finds that the variants are not within the threshold value, the document processing apparatus transfers its processing to step S42 to set the count value i of the counter to "1" to execute again the sequence of steps of calculating the center active value of the elements of the document. In the document processing apparatus, the variants are decreased gradually each time the loop from step S42 to step S46 is repeated.

The document processing apparatus is able to execute the active diffusion in the manner described above. The link processing performed at step S43 to carry out this active diffusion is now explained with reference to FIG. 18. Meanwhile, although the flowchart of FIG. 18 shows the processing on the sole element $E_i$, this processing is executed on the totality of the elements.

Figure 18:
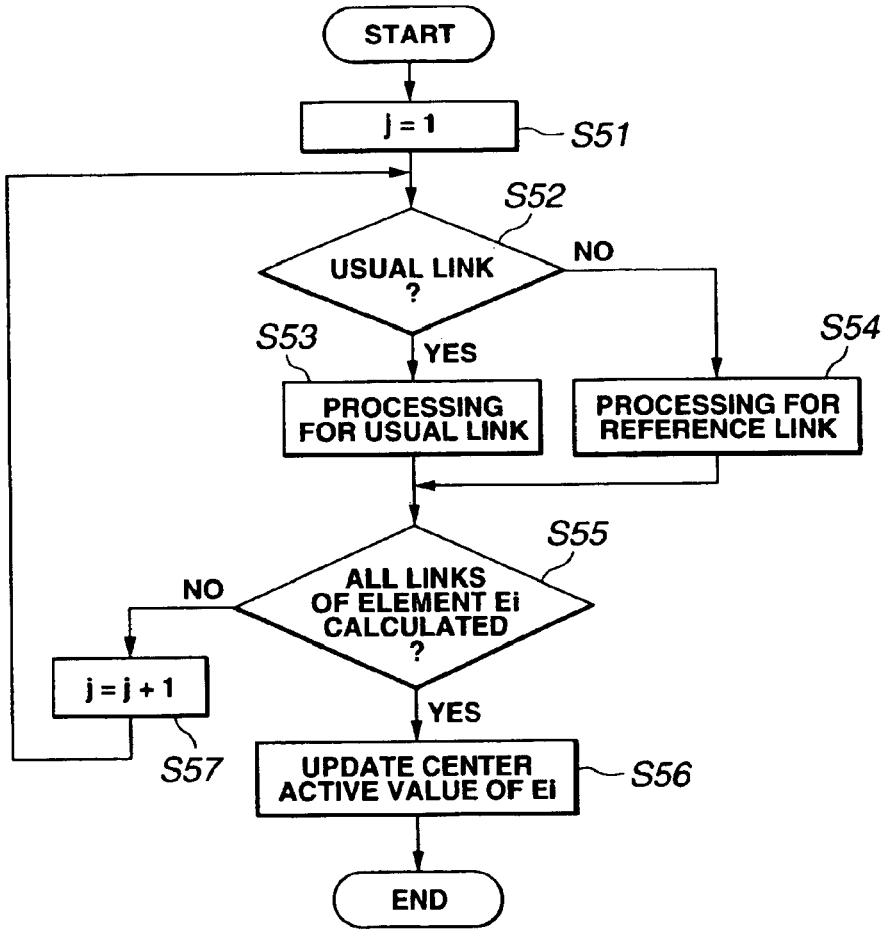
FIG. 18 is a flowchart for illustrating a sequence of processing operations in performing link processing for active diffusion.
Figure 19:
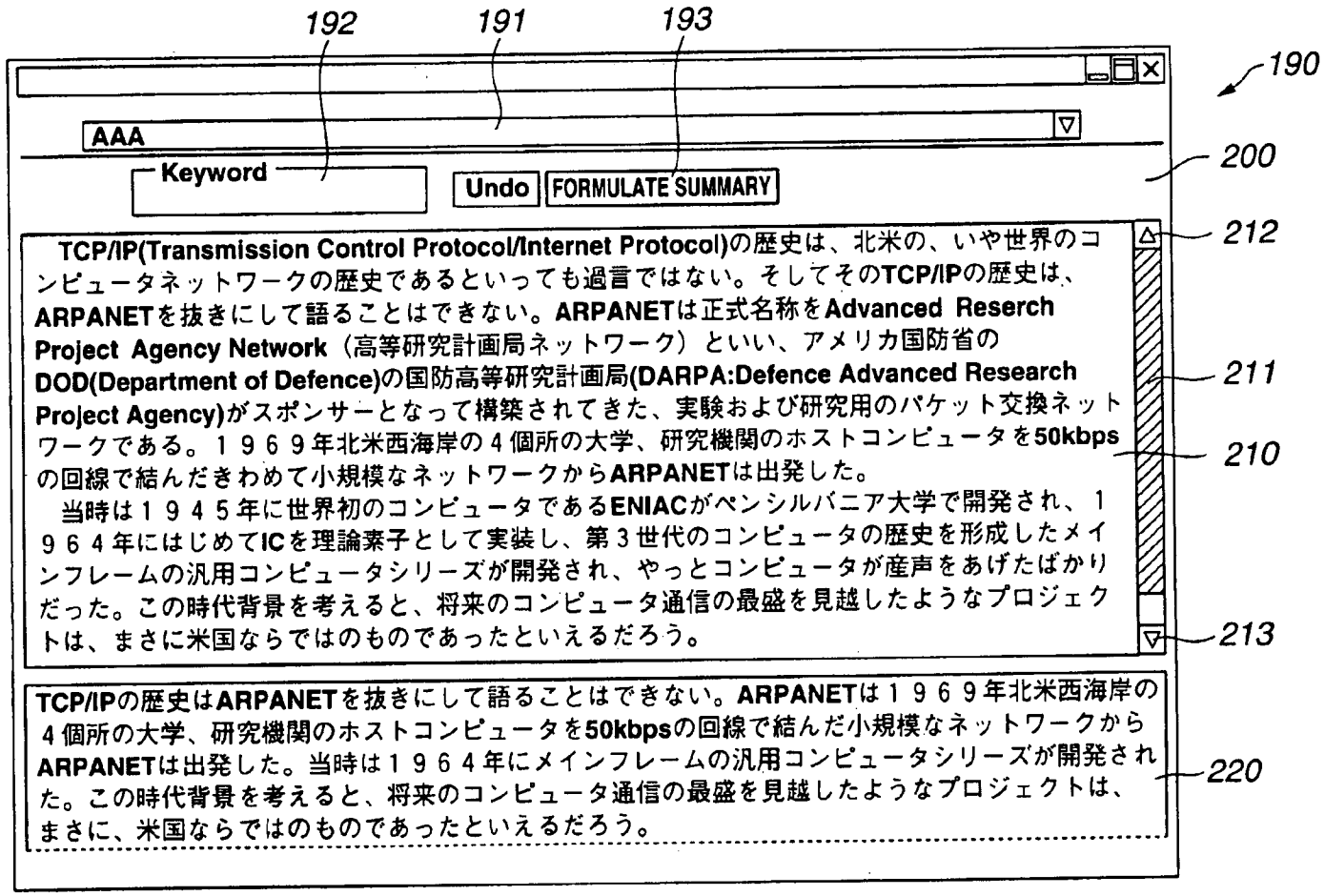
FIG. 19 shows a document and a window demonstrating its summary test.
Figure 20:
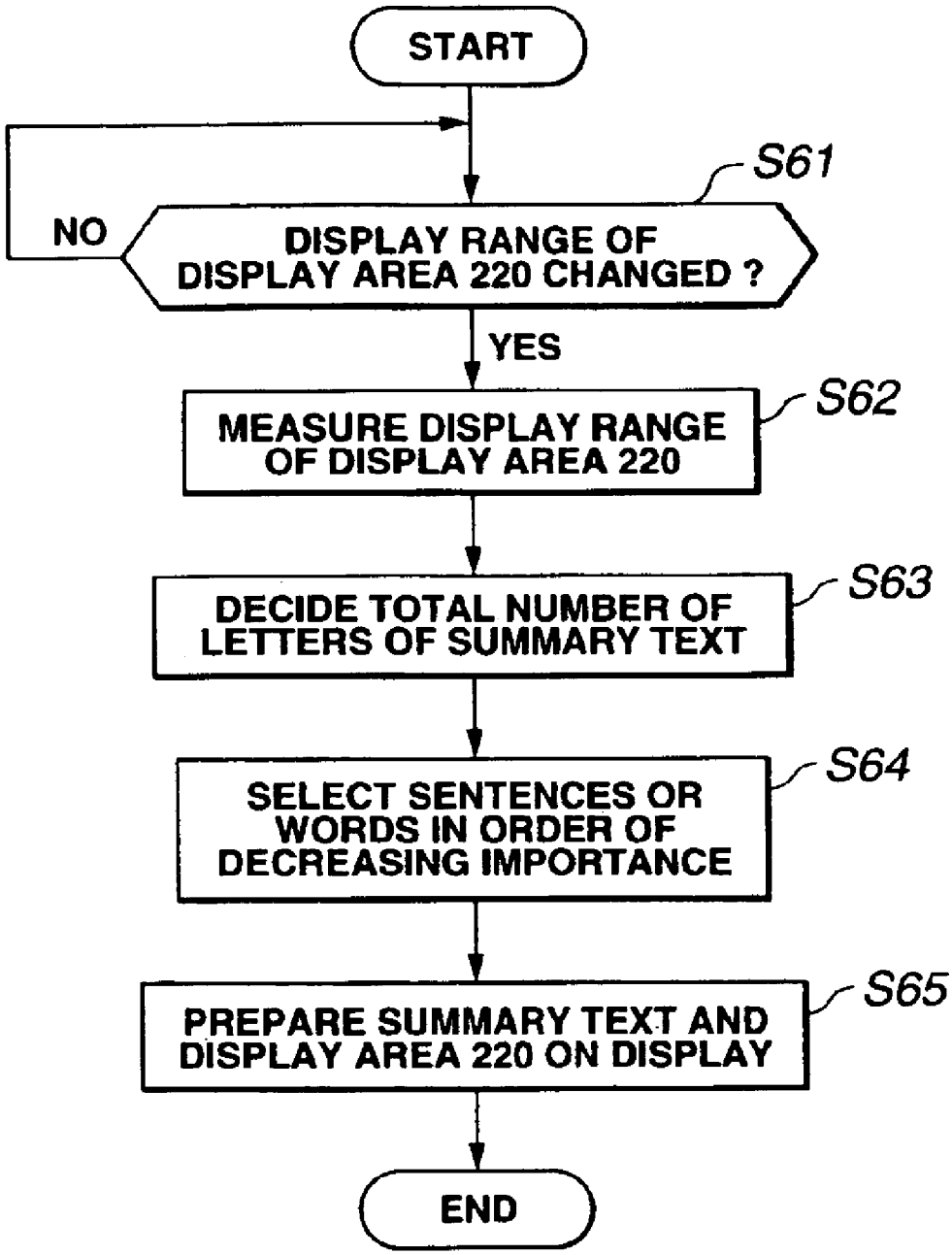
FIG. 20 is a flowchart for illustrating a sequence of processing operations in changing a demonstration area for a summary text to prepare a summary text newly.

First, at step S51, the document processing apparatus initializes the counter adapted for counting the link having its one end connected to an element $E_i$ constituting the document, as shown in FIG. 18. That is, the document processing apparatus sets the count value j of the link counting counter to "1". This counter references a first link $L_{ij}$ connected to the element $E_i$.

The document processing apparatus then references at step S52 a tag of the relational attribute on the link $L_{ij}$ interconnecting the elements $E_i$ and $E_j$, under control by the CPU 13, to verify whether or not the link $L_{ij}$ is the normal link. The document processing apparatus verifies which one of the normal link showing the relation between the vocabulary element associated with a word, a sentence element associated with the sentence and a paragraph element associated with the paragraph and the reference link indicating the modifying/modified relation by the referencing/referenced relation is the link $L_{ij}$. If the document processing apparatus finds that the link $L_{ij}$ is the normal link, the document processing apparatus transfers its processing to step S53. If the document processing apparatus finds that the link $L_{ij}$ is the reference link, it transfers its processing to step S54.

If the document processing apparatus verifies that the link $L_{ij}$ is the normal link, it performs at step S53 the processing of calculating a new terminal point active value of a terminal point $T_{ij}$ of the element $E_i$ connected to the normal link $L_{ij}$.

At this step S53, the link $L_{ij}$ has been clarified to be a normal link by the verification at step S52. The new terminal point active value $t_{ij}$ of the terminal point $T_{ij}$ of the element $E_i$ may be found by summing terminal point active values $t_{jp}$, $t_{jq}$ and $t_{jr}$ of the totality of the terminal points $T_{jp}$, $T_{jq}$ and $T_{jr}$ connected to the links other than the link $L_{ij}$, among the terminal point active values of the element $E_i$, to the center active value $e_j$ of the element $E_i$ connected to the element $E_i$ by the link $L_{ij}$, and by dividing the resulting sum by the total number of the elements contained in the document.

The document processing apparatus reads out the terminal point active values and the center active values as required for e.g., the RAM 14, and calculates a new terminal point active value of the terminal point connected to the normal link on the read-out terminal point and center active values. The document processing apparatus then causes the new terminal point active values, thus calculated, to be stored e.g., in the RAM 14.

If the document processing apparatus finds that the link $L_{ij}$ is not the normal link, the document processing apparatus at step S54 performs the processing of calculating the terminal point active value of the terminal point $T_{ij}$ connected to the reference link of the element $E_i$.

At this step S54, the link $L_{ij}$ has been clarified to be a reference link by the verification at step S52. The terminal point active value $t_{ij}$ of the terminal point $L_{ij}$ of the element $E_i$ connected to the reference link $L_{ij}$ may be found by summing terminal point active values $t_{jp}$, $t_{jq}$ and $t_{jr}$ of the totality of the terminal points $T_{jp}$, $T_{jq}$ and $t_{ij}$ connected to the links other than the link $L_{ij}$, among the terminal point active values of the element $E_j$, to the center active value $e_j$ of the element $E_j$ connected to the element $E_i$ by the link $L_{ij}$, and by dividing the resulting sum by the total number of the elements contained in the document.

The document processing apparatus reads out the terminal point active values and the center active values as required for e.g., the RAM 14, and calculates a terminal point active value and a center active value from the terminal point active value and the center active value stored in the RAM 14. The document processing apparatus calculates a new terminal point active value and a center active value, connected to the reference link as discussed above, using the read-out terminal point active value and center active value thus read out. The document processing apparatus then causes the new terminal point active values, thus calculated, to be stored e.g., in the RAM 14.

The processing of the normal link at step S53 and the processing of the reference link at step S54 are executed on the totality of links $L_{ij}$ connected to the element $E_i$ referenced by the count value i, as shown by the loop proceeding from step S52 to step S55 and reverting through step S57 to step S52. Meanwhile, the count value j counting the link connected to the element $E_i$ is incremented at step S57.

After performing the processing of steps S53 and S54, the document processing apparatus at step S55 verifies, under control by the CPU 13, whether or not the terminal point active values have been calculated for the totality of links connected to the element $E_i$. If the document processing apparatus has verified that the terminal point active values have been calculated on the totality of links, it transfers the processing to step S56. If the document processing apparatus has verified that the terminal point active values have not been calculated on the totality of links, it transfers the processing to step S57.

If the document processing apparatus has found that the terminal point active values have been calculated on the totality of links, the document processing apparatus at step S56 executes updating of the center active values $e_i$ of the element $E_i$, under control by the CPU 13.

The new value of the center active value $e_i$ of the element $E_i$, that is an updated value, may be found by taking the sum of the curent center active value $e_i$ of the element $E_i$ and the new terminal point active values of the totality of the terminal points of the element $E_i$, or $e_i'=e_i+\Sigma t_j'$. The prime symbol "" means a new value. In this manner, the new center active value may be found by summing the original center active value of the element to the sum total of the new terminal point active value of the terminal point of the element.

The document processing apparatus reads out necessary terminal point active value from the terminal point active values and the center active values stored e.g., in the RAM 14. The document processing apparatus executes the above-described calculations to find the center active value $e_j$ of the element $E_i$, and causes the so-calculated new center active value $e_j$ to be stored in e.g., the RAM 14.

In this manner, the document processing apparatus calculates the new center active value for each element in the document, and executes active diffusion shown at step S21 in FIG. 15.

Figure 13:
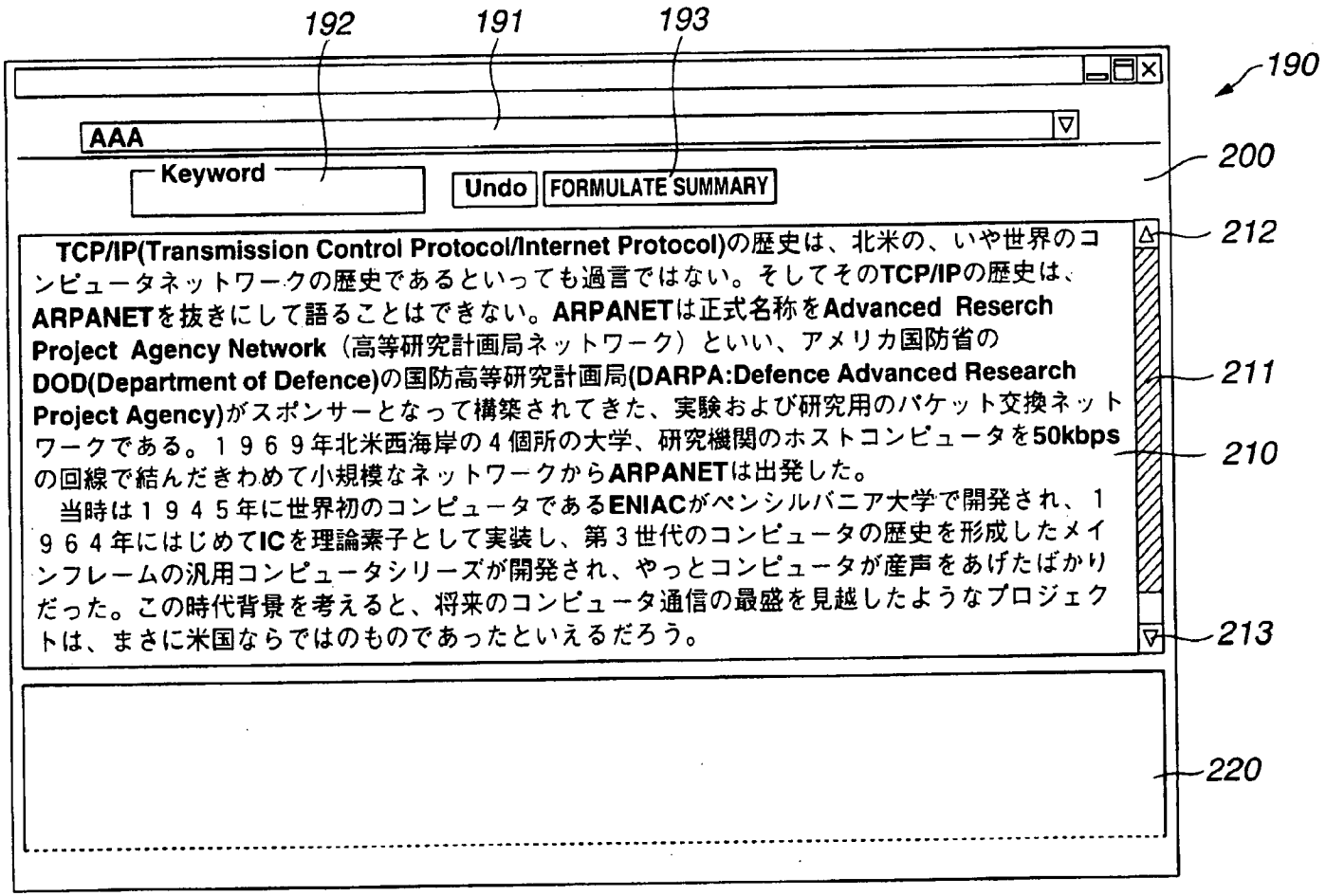
FIG. 13 shows a window demonstrating a document.

At step S22 in FIG. 15, the document processing apparatus sets the size of the display area 220 of the window 190 demonstrated on the display unit 31 shown in FIG. 13, that is the maximum number of characters that can be demonstrated on the display area 220, to $W_s$, under control by the CPU 13. On the other hand, the document processing apparatus initializes the summary text S, under control by the CPU 13, to set the initial value $S_o$=. This denotes that no character queue is present in the summary text. The document processing apparatus causes the maximum number of characters $W_s$ that can be demonstrated on the display area 220, and the initial value $S_0$ of the summary S, thus set, to be memorized e.g., in the RAM 14.

The document processing apparatus then sets at step S23 the count value i of the counter for counting the sequential formulation of the skeleton of the summary text to "1". That is, the document processing apparatus sets the count value i to i=1. The document processing apparatus causes the so-set count value i to be stored e.g., in the RAM 14.

The document processing apparatus then extracts at step S24 the skeleton of a sentence having the i'th highest average center active value from the sentence, the summary text of which is to be prepared, for the count value i of the counter, under control by the CPU 13. The average center active value is an average value of the center active values of the respective elements making up a sentence. The document processing apparatus reads out the summary text $S_{i-1}$ stored in the RAM 14 and sums the letter queue of the skeleton of the extracted sentence to the summary $S_{i-1}$ to give a summary text $S_i$. The document processing apparatus causes the resulting summary text $S_i$ to be stored e.g., in the RAM 14. Simultaneously the document processing apparatus formulates a list $l_i$ of the elements not contained in the sentence skeleton, in the order of the decreasing center active values, to cause the list $l_i$ to be stored e.g., in the RAM 14.

That is, at step S24, the document processing apparatus selects the sentences in the order of the decreasing average center active values, using the results of the active diffusion, under control by the CPU 13, to extract the skeleton of the selected sentence. The sentence skeleton is constituted by indispensable elements extracted from the sentence. What can become the indispensable elements are elements having the relational attribute of a head of an element, a subject, an indirect object, a possessor, a cause, a condition or comparison, and elements directly contained in a coordinate structure in the relevant element retained to be the coordinate structure is an indispensable element. The document processing apparatus connects the indispensable elements to form a sentence skeleton to add it to the summary text.

The document processing apparatus then verifies, at step S25, whether or not the length of a summary $S_i$, that is the number of letters, is more than the maximum number of letters $W_s$ in the display area 220 of the window 190, under control by the CPU 13.

If the document processing apparatus verifies that the number of letters of the summary $S_i$ is larger than the maximum number of letters $W_s$, it sets at step S30 the summary $S_{i-1}$ as the ultimate summary text, under control by the CPU 13, to finish a sequence of processing operations. Since the summary $S_i$=$S_o$="" is output in this case, the summary text is not demonstrated on the display area 220.

If conversely the document processing apparatus verifies that the number of letters of the summary $S_i$ is not larger than the maximum number of letters $W_s$, it transfers to processing at step S26 to compare the center active value of the sentence having the (i+1) summary text largest average center active value to the center active value of the element having the largest center active value among the elements of the list $l_i$ prepared at step S24, under control by the CPU 13. If the document processing apparatus has verified that the center active value of the sentence having the (i+1) summary text largest center active value is larger than the center active value of the element having the largest center active value among the elements of the list $l_i$, it transfers to processing at step S28. If conversely the document processing apparatus has verified that the center active value of the sentence having the (i+1) summary text largest center active value is larger than the center active value of the element having the largest center active value among the elements of the list $l_i$, it transfers to processing at step S27.

If the document processing apparatus has verified that the center active value of the sentence having the (i+1) summary text largest center active value is not larger than the center active value of the element having the largest center active value among the elements of the list $l_i$, it increments the count value i of the counter by "1" at step S27, under control by the CPU 13, to then revert to the processing of step S24.

If the document processing apparatus has verified that the center active value of the sentence having the (i+1) summary text largest center active value is larger than the center active value of the element having the largest center active value among the elements of the list $l_i$, it sums the element e with the largest center active value among the elements of the list $l_i$ to the summary $S_i$ to generate $SS_i$ while deleting the element e from the list $l_i$. The document processing apparatus causes the summary $SS_i$ thus generated to be memorized in e.g., the RAM 14.

The document processing apparatus then verifies, at step S29, whether or not the number of letters of the summary $SS_i$ is larger than the maximum number of letters Ws of the display area 220 of the window 190, under control by the CPU 13. If the document processing apparatus has verified that the number of letters of the summary $SS_i$ is not larger than the maximum number of letters $W_s$ of the display area 220 of the window 190, the document processing apparatus repeats the processing as from step S26. If conversely the document processing apparatus has verified that the number of letters of the summary $SS_i$ is larger than the maximum number of letters $W_s$, the document processing apparatus sets the summary $S_i$ at step S31 as being the ultimate summary text, under control by the CPU 13, and displays the summary $S_i$ to finish the sequence of operations. In this manner, the document processing apparatus generates the summary text so that its number of letters is not larger than the maximum number of letters $W_s$.

By executing the above-described sequence of operations, the document processing apparatus formulates a summary text by summarizing the tagged document. If the document shown in FIG. 13 is summarized, the document processing apparatus forms the summary text shown for example in FIG. 19 to display the summary text in the display area 220 of the display range.

Specifically, the document processing apparatus forms the summary text: "TCP/IP の歴史は ARPANET

を抜きにして語ることはできない。ＡＲＰＡＮＥＴ

は 1969年北米西海岸の個所の大学、研究機関のホストコンピュータを

の回線で結んだ小規模 50 kbps なネットワークからは出発し ARPA-

NET た。当時は年にメ 1964

ムの汎用コンピュータシリーズ

インフレー

が開発された。この時代背景を考えるが開発され

ンピュータ通信の最盛を見越したこた のようなプ

ロジェクトは、まさに米国ならではのものであったといえるだろう。 which reads: "The history of the TCP/IP cannot be discussed if APPANET is discounted. The APPANET was initiated from a network of an extremely small scale which interconnected host computers of four universities and research laboratories on the west coast of North America in 1969. At the time, a main-frame general-purpose computer was developed in 1964. In light of this historical background, such project, which predicted the prosperity of future computer communication, may be said to be truly American", to demonstrate the summary text in the display area 220.

In the document processing apparatus, the user reading this summary text instead of the entire document is able to comprehend the gist of the document to verify whether or not the sentence is the desired information.

For adding the degree of importance to elements in the document, by the document processing apparatus, it is not necessary to use the above-described active diffusion, since the method of weighting words by the tf*id method and to use the sum total of the weights to the words appearing in the document as the degree of importance of the document, as proposed by K. Zechner. This method is discussed in detail in K. Zechner, Fast Generation of Abstracts from general domain text corpora by extracting relevant Sentences, In Proc. of the 16th International Conference on Computational Linguistics, pp. 986–989, 1996. For adding the degree of importance, any suitable methods other than those discussed above may be used. It is also possible to set the degree of importance based on a keyword input to the key word input portion 192 of the display area 200.

Meanwhile, the document processing apparatus is able to enlarge the display range of the display area 220 of the window 190 demonstrated on the display unit 31. If, with the formulated summary text displayed on the display area 220, the display range of the display area 220 is changed, the information volume of the summary text can be changed responsive to the display range. In such case, the document processing apparatus performs the processing shown in FIG. 20.

That is, the document processing apparatus is responsive to actuation by the user on the input unit 20, at step S61, under control by the CPU 13, to wait until the display range of the display area 220 of the window 190 demonstrated on the display unit 31 is changed.

If the display range of the display area 220 is changed, the document processing apparatus transfers to step S62 ro measure the display range of the display area 220 under control by the CPU 13.

The processing performed at steps S63 to S65 is similar to that performed at step S22 et seq., such that the processing is finished when the summary text corresponding to the display range of the display area 220 is created.

That is, the document processing apparatus at step S63 determines the total number of letters of the summary text demonstrated on the display area 220, based on the measured result of the display area 220 and on the previously specified letter size.

The document processing apparatus at step S64 selects sentences or words from the RAM 14, under control by the CPU 13, in the order of the decreasing degree of importance, so that the number of letters of the created summary as determined at step S63 will not be exceeded.

The document processing apparatus at step S65 joins the sentences or paragraphs selected at step S64 to prepare a summary text which is demonstrated on the display area 220 of the display unit 31.

Figure 21:
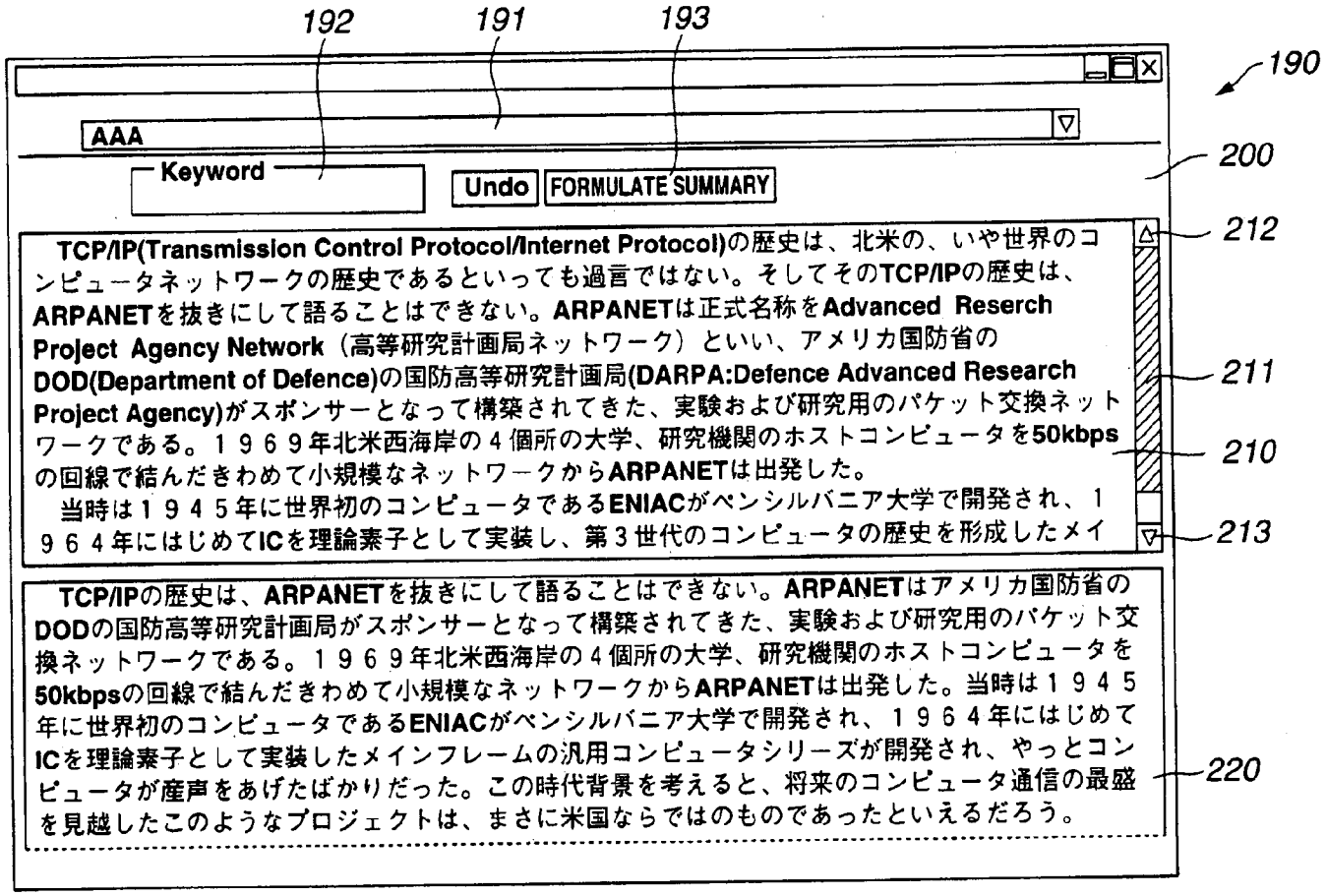
FIG. 21 shows a window representing a document and a window demonstrating its summary text and specifically shows a summary text demonstrated on the window shown in FIG. 14.

The document processing apparatus, performing the above processing, is able to newly formulate the summary text conforming to the display range of the display area 220. For example, if the user enlarges the display range of the display area 220 by dragging the mouse of the input unit 20, the document processing apparatus newly forms a more detailed summary text to demonstrate the new summary text in the display area 220 of the window 190, as shown in FIG. 21.

That is, the document processing apparatus forms the following summary text: "TCP/IP の歴史は ARPANET

を抜きにして語ることはできない。ＡＲＰＡＮＥＴ

はアメリカ国防省 ＤＯＤ

防省のがスポンサーとなって構 築されてきた、

の国防高等

実験および研究用のパケット交換ネットワー 1969

クである。年北米西んだきわめて小規模なネットワ 50 kbps

ークからは出発しは出発した。当時は ARPANET 年に世界初 1945

のコンピュータである ＥＮＩＡＣ

がペンシルバニア大学で開発され、 1964 年にはじ ＩＣ

を理論素子として実装し、インフレーインフレー

めて

ムの汎用コンピュータシリーズ

が開発され、やっとコンピュータが産声

をあげたばかりあった。この時代背景を考

えると、将来タ通信の最盛を見越したこ のようなプ のようなプ

ロジェクトは、まさに米国ならではのものであったといえるだろう。 which reads: "The history of TCP/IP cannot be discussed if APPANET is discounted. The APPANET is a packet exchanging network for experimentation and research constructed under the sponsorship of the DARPA (Defence Advanced Research Project Agency) of the DOD (Department of Defence) of the Department of Defence. The APPANET was initiated from a network of an extremely small scale which interconnected host computers of four universities and research laboratories on the west coast of North America in 1969. Historically, the ENIAC, as the first computer in the world, was developed in 1945 in Pennsylvania University. It was a main frame general-purpose computer series, loaded with an IC as a theoretical device and which commenced the history of the third generation computer, in 1964, that marked the beginning of a usable computer. In light of this historical background, such project, which predicted the prosperity of future computer communication, may be said to be truly American" to demonstrate the summary text in the display area 220.

So, if the summary text displayed in the document processing apparatus is too concise for understanding the outline of the document, the user may enlarge the display range of the display area 220 to reference a more detailed summary text having a larger information volume.

Figure 22:
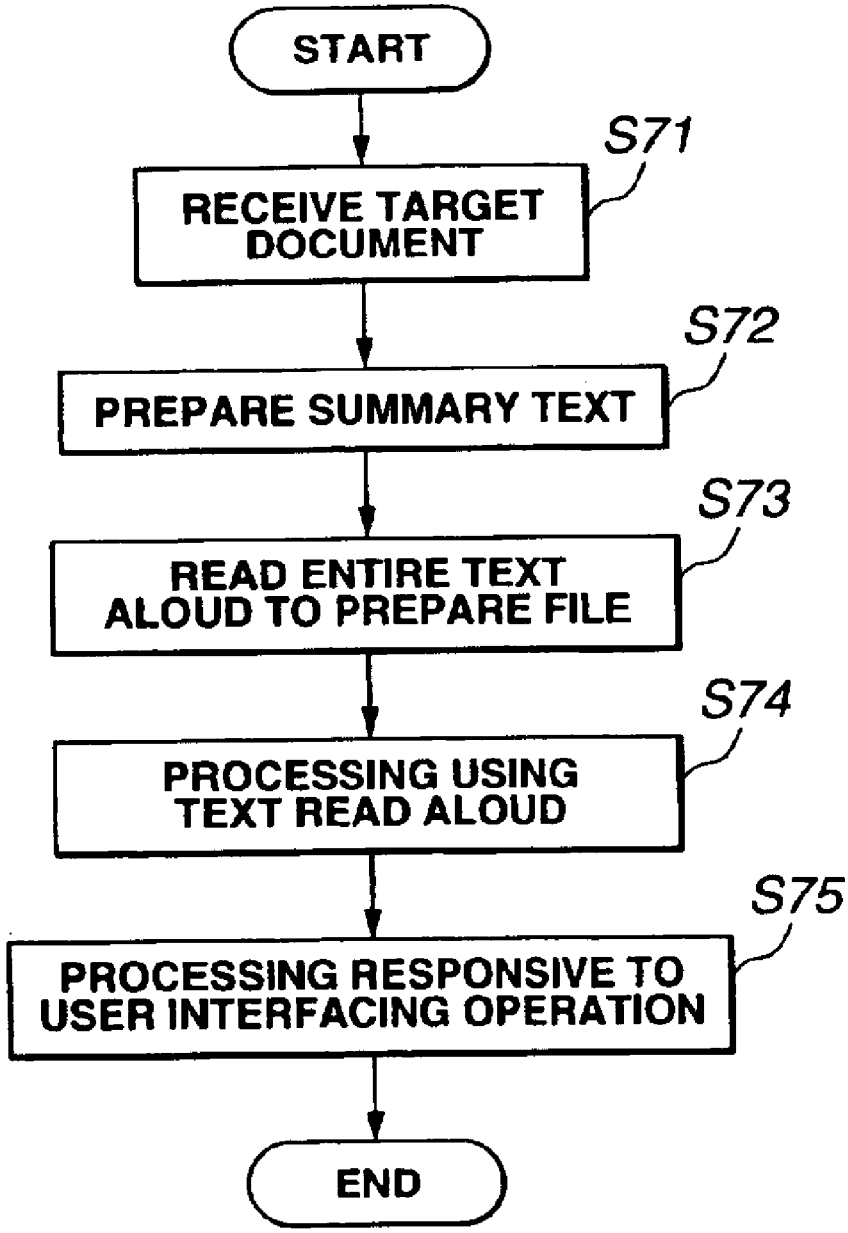
FIG. 22 is a flowchart for illustrating a sequence of processing operations in preparing a summary text to read out a document.

If, in the document processing apparatus, the summary text of a document is to be formulated as described above, and the signal recording pattern of the electronic document processing program, recorded on the ROM 15 or the hard disc, is booted by the CPU 13, the document or the summary text can be read out by carrying out the sequence of steps shown in FIG. 22. Here, the document shown in FIG. 6 is taken as an example for explanation.

First, the document processing apparatus receives a tagged document at step S71, as shown in FIG. 22. Meanwhile, the document is added with tags necessary for speech synthesis and is constructed as a tagged file shown in FIG. 8. The document processing apparatus is also able to receive the tagged document and adds new tags necessary for speech synthesis to form a document. The document processing apparatus is also able to receive a non-tagged document to add tags inclusive of those necessary for speech synthesis to the received document to prepare a tagged file. This process corresponds to step S1 in FIG. 4.

The document processing apparatus then prepares at step S72 a summary text of the document, by a method as described above, under control by the CPU 13. Since the document, the summary text of which has now been prepared, is tagged as shown at step S71, the tags corresponding to the document are similarly added to the prepared summary text.

The document processing apparatus then generates at step S73 a speech read-out file for the total contents of the document, based on the tagged file, under control by the CPU 13. This speech read-out file is generated by deriving the attribute information for reading out the document from the tags included in the tagged file to embed this attribute information.

Figure 23:
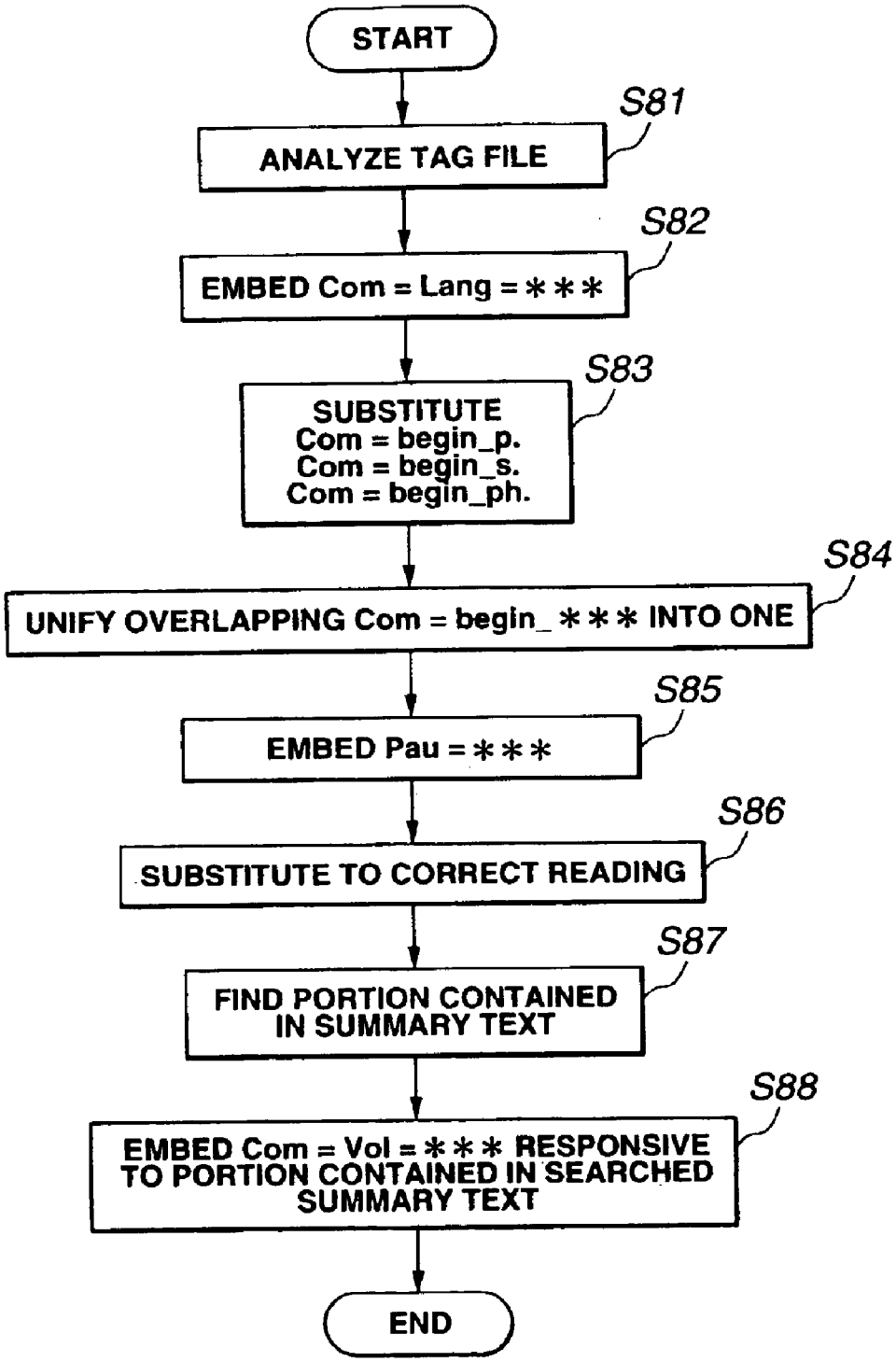
FIG. 23 is a flowchart for illustrating a sequence of processing operations in preparing a summary text to then read out a document.

At this time, the document processing apparatus generates the speech read-out file by carrying out the sequence of steps shown in FIG. 23.

First, the document processing apparatus at step S81 analyzes the tagged file, received or formed, by the CPU 13. At this time, the document processing apparatus checks the language with which the document is formed and finds out the beginning positions of the paragraphs, sentences and phrases of the document and the reading attribute information based on the tags.

The document processing apparatus at step S82 embeds Com=Lang=*, by the CPU 13**, at the document beginning position, depending on the language with which the document is formed. Here, the document processing apparatus embeds Com=Lang=ENG at the document beginning position.

The document processing apparatus at step S84 substitutes the attribute information in the speech read-out file by the CPU 13 for the beginning positions of the paragraphs, sentences and phrases of the document. That is, the document processing apparatus substitutes Com=begin_p, Com=begin_s and Com=begin_ph for the <paragraph>, <sentence> and <***phrase> in the tagged file, respectively.

The document processing apparatus then unifies at step S84 the same Com=begin_* overlapping due to the same level syntactic structure into the sole Com=begin_* by the CPU 13.

The document processing apparatus then embeds at step S85 Pau=* in association with Com=begin_* by the CPU 13. That is, the document processing apparatus embeds Pau=500 directly before Com=begin_p, while embedding Pau=100 and Pau=50 directly before Com=begin_s and Com=begin_ph, respectively.

At step S86, the document processing apparatus substitutes correct reading by the CPU 13 based on the reading attribute information. The document processing apparatus substitutes [two] for [II] based on the reading attribute information pronunciation="two".

The document processing apparatus then finds out at step S87 the portion included in the summary text by the CPU 13.

At step S88, the document processing apparatus embeds by the CPU 13 Com=Vol=* depending on the portion included in the summary text found out at step S87. Specifically, the document processing apparatus embeds Com=Vol=80, on the element basis, at the beginning position of the portion of the entire contents of the document which is included in the summary text prepared at step S72 in FIG. 22, while embedding the attribute information Com=Vol=0 in the beginning position of the remaining document portions. That is, the document processing apparatus reads out the portion included in the summary text with a sound volume increased 80% from the default sound volume. Meanwhile, the sound volume need not be increased by 80% from the default sound volume, but may be suitably modified. Depending on the document portion found out at step S87, the document processing apparatus may embed the attribute information specifying different speech synthesis engines, without embedding only Com=Vol=*, to vary the read-out voice between e.g., the male voice and the female voice, so that the summary text reading voice will differ from that reading out the document portion not included in the summary text. Thus, in the document processing apparatus, the document portion included in the summary text may be intoned in reading it out to instigate the user attention.

The document processing apparatus performs the processing shown in FIG. 23 at step S73 in FIG. 22 to generate the speech read-out file automatically. The document processing apparatus causes the generated speech read-out file to be stored in the RAM 14. Meanwhile, this process corresponds to step S2 in FIG. 4.

At step S74 in FIG. 22, the document processing apparatus performs processing suited to the speech synthesis engine pre-stored in the ROM 15 or in the hard disc, under control by the CPU 13. This process corresponds to step S3 in FIG. 4.

The document processing apparatus at step S75 performs the processing conforming to the user operation employing the above-mentioned user interface. This process corresponds to the step S4 in FIG. 4. By the user selecting a selection switch 184 of the user interface window 170 shown in FIG. 12, the summary text prepared at step S72 may be selected as an object to be read out. In this case, the document processing apparatus may start to read the summary text out if the user pushes the replay button 171 by the user acting on e.g., the mouse of the input unit 20. Also, if the user selects the selection switch 183 using the mouse of the input unit 20 to press the replay button 171, the document processing apparatus starts reading the document out, as described above. In this case, the document processing apparatus is able to read out the summary text with pause periods different at the beginning positions of the paragraphs, sentences and phrases based on the attribute information Pau=* embedded at step S73** in the speech read-out file. Moreover, the document processing apparatus may read out the document not only by increasing the sound volume of the voice for the document portion included in the summary text but also by emphasizing the accents as necessary or by reading out the document portion included in the summary text with a voice having different characteristics from those of the voice reading out the document portion not included in the summary text.

By performing the above processing, the document processing apparatus can read out a given text or a summary text formulated. On the other hand, the document processing apparatus in reading out a given document is able to change the manner of reading out the document depending on the formulated summary text such as by intoning the document portion included in the formulated summary text.

As described above, the document processing apparatus is able to generate the speech read-out file automatically from a given document to read out the document or the summary text prepared therefrom using a proper speech synthesis engine. At this time, the document processing apparatus is able to increase the sound volume of the document portion included in the summary text prepared to intone the document portion to instigate user's attention. Also, the document processing apparatus discriminates the beginning portions of the paragraphs, sentences and phrases, and provides respective different pause periods at respective beginning portions. Thus, natural reading without extraneous feeling can be achieved.

The present invention is not limited to the above-described embodiment. For example, the tagging to the document or the speech read-out file is, of course, not limited to that described above.

Although the document is transmitted in the above-described embodiment to the communication unit 22 from outside over the telephone network, the present invention is not limited to this embodiment. For example, the present invention may be applied to a case in which the document is transmitted over a satellite, while it may also be applied to a case in which the document is read out from a recording medium 33 in a recording and/or reproducing unit 32 or in which the document is recorded from the outset in the ROM 15.

Although the speech read-out file is prepared from the tagged file received or formulated, it is also possible to directly read out the tagged file without preparing such speech read-out file.

In this case, the document processing apparatus may discriminate the paragraphs, sentences and phrases, after receiving or preparing the tagged file, using the speech synthesis engine, based on tags appended to the tagged file for indicating the paragraphs, sentences and phrases, to read out the file with a pre-set pause period at the beginning portions of these paragraphs, sentences and phrases. The tagged file is added with the attribute information for inhibiting the reading out or indicating the pronunciation. So, the document processing apparatus reads the tagged file out as it removes the passages for which the reading out is inhibited, and as it substitutes the correct reading or pronunciation. The document processing apparatus is also able to execute locating, fast feed and rewind in reading out the file from one paragraph, sentence or phrase to another, based on tags indicating the paragraph, sentence or phrase, by the user acting on the above-mentioned user interface during reading out.

In this manner, the document processing apparatus is able to directly read the document out based on the tagged file, without generating a speech read-out file.

Moreover, according to the present invention, a disc-shaped recording medium or a tape-shaped recording medium, having the above-described electronic document processing program recorded therein, may be furnished as the recording medium 33.

Although the mouse of the input unit 20 is shown as an example as a device for acting on variable windows demonstrated on the display unit 31, the present invention is also not to be limited thereto since a tablet or a write pen may be used as this sort of the device.

Although the documents in English and Japanese are given by way of illustration in the above-described embodiments, the present invention may. Of course, be applied to any optional languages.

The present invention can, of course, be modified in this manner without departing its scope.

INDUSTRIAL APPLICABILITY

The electronic document processing apparatus according to the present invention, for processing an electronic document, described above, includes document inputting means fed with an electronic document, and speech read-out data generating means for generating speech read-out data for reading out by a speech synthesizer based on an electronic document.

Thus, the electronic document processing apparatus according to the present invention is able to generate speech read-out data based on the electronic document to read out an optional electronic document by speech synthesis to high precision without extraneous feeling.

The electronic document processing method according to the present invention includes a document inputting step of being fed with an electronic document and a speech read-out data generating step of generating speech read-out data for reading out on the speech synthesizer based on the electronic document.

Thus, the electronic document processing method according to the present invention is able to generate speech read-out data based on the electronic document to read out an optional electronic document by speech synthesis to high precision without extraneous feeling.

Moreover, the recording medium, having an electronic document processing program recorded thereon, according to the present invention, is a recording medium having recorded thereon a computer-controllable electronic document processing program for processing the electronic document. The program includes a document inputting step of being fed with an electronic document and a speech read-out data generating step of generating speech read-out data for reading out on the speech synthesizer based on the electronic document.

So, with the recording medium, having the electronic document processing program for processing the electronic document, recorded thereon, according to the present invention, there may be provided an electronic document processing program for generating speech read-out data based on the electronic document. Thus, an apparatus furnished with this electronic document processing program, is able to read an optional electronic document out to high accuracy without extraneous feeling by speech synthesis using the speech read-out data.

Moreover, the electronic document processing apparatus according to the present invention includes document inputting means for being fed with the electronic document of a hierarchical structure having a plurality of elements and to which is added the tag information indicating the inner structure of the electronic document, and document read-out means for speech-synthesizing and reading out the electronic document based on the tag information.

So, with the electronic document processing apparatus, according to the present invention, fed with the electronic document of a hierarchical structure having a plurality of elements and to which is added the tag information indicating its inner structure, the electronic document can be directly read out with high accuracy without extraneous feeling based on the tag information added to the document.

With the electronic document processing apparatus, according to the present invention, includes an electronic document processing method for processing an electronic document, including a document inputting step of being fed with the electronic document of a hierarchical structure having a plurality of elements and to which is added the tag information indicating the inner structure of the electronic document, and a document read-out step of speech-synthesizing and reading out the electronic document based on the tag information.

So, with the electronic document processing method, according to the present invention, fed with the electronic document of a hierarchical structure having a plurality of elements and to which is added the tag information indicating its inner structure, the electronic document can be directly read out with high accuracy without extraneous feeling based on the tag information added to the document.

In the recording medium, having recorded thereon an electronic document processing program, recorded thereon, there may be provided a computer-controllable electronic document processing program including a document inputting step of being fed with the electronic document of a hierarchical structure having a plurality of elements and having added thereto the tag information indicating its inner structure and a document read-out step of speech-synthesizing and reading out the electronic document based on the tag information.

So, with the recording medium, having recorded thereon an electronic document processing program, recorded thereon, according to the present invention, there may be provided an electronic document processing program having a step of being fed with the electronic document of a hierarchical structure having a plurality of elements and having the tag information indicating its inner structure and a step of directly reading out the electronic document high accurately without extraneous feeling. Thus, the device furnished with this electronic document processing program is able to be fed with the electronic document to read out the document highly accurately without extraneous feeling.

With the electronic document processing apparatus, according to the present invention, provided with summary text forming means for forming a summary text of the electronic document, and speech read-out data generating means for generating speech read-out data for reading the electronic document out by a speech synthesizer, in which the speech read-out data generating means generates the speech read-out data as it adds the attribute information indicating reading out a portion of the electronic document included in the summary text with emphasis as compared to a portion thereof not included in the summary text.

So, with the electronic document processing apparatus, according to the present invention, in which the attribute information indicating reading out a portion of the electronic document included in the summary text with emphasis as compared to a portion thereof not included in the summary text is added to generate speech read-out data, any optional electronic document may be read out highly accurately without extraneous feeling using the speech read-out data with emphasis as to the crucial portion included in the summary text.

The electronic document processing method, according to the present invention, includes a summary text forming step of forming a summary text of the electronic document and a speech read-out data generating step of generating speech read-out data for reading the electronic document out by a speech synthesizer. The speech read-out data generating step generates the speech read-out data as it adds the attribute information indicating reading out a portion of the electronic document included in the summary text with emphasis as compared to a portion thereof not included in the summary text.

So, with the electronic document processing method, according to the present invention, in which the attribute information indicating reading out a portion of the electronic document included in the summary text with emphasis as compared to a portion thereof not included in the summary text is added to generate speech read-out data, any optional electronic document may be read out highly accurately without extraneous feeling using the speech read-out data with emphasis as to the crucial portion included in the summary text.

In the recording medium having recorded thereon a computer-controllable program for processing an electronic document, according to the present invention, the program includes a summary text forming step of forming a summary text of the electronic document and a speech read-out data generating step of generating speech read-out data for reading the electronic document out by a speech synthesizer. The speech read-out data generating step generates the speech read-out data as the attribute information indicating reading out a portion of the electronic document included in the summary text with emphasis as compared to a portion thereof not included in the summary text.

So, with the recording medium having recorded thereon the electronic document processing program, according to the present invention, there may be provided such a program in which the attribute information indicating reading out a portion of the electronic document included in the summary text with emphasis as compared to a portion thereof not included in the summary text is added to generate speech read-out data. Thus, an apparatus furnished with this electronic document processing program is able to read any optional electronic document out highly accurately without extraneous feeling using the speech read-out data with emphasis as to the crucial portion included in the summary text.

The electronic document processing apparatus according to the present invention, includes summary text forming means for preparing a summary text of the electronic document and document read-out means for reading out a portion of the electronic document included in the summary text with emphasis as compared to a portion thereof not included in the summary text.

So, the electronic document processing apparatus according to the present invention is able to read any optional electronic document out highly accurately without extraneous feeling using the speech read-out data with emphasis as to the crucial portion included in the summary text.

The electronic document processing method according to the present invention includes a summary text forming step for forming a summary text of the electronic document and a document read out step of reading out a portion of the electronic document included in the summary text with emphasis as compared to the portion thereof not included in the summary text.

So, the electronic document processing method according to the present invention renders it possible to read any optional electronic document out highly accurately without extraneous feeling using the speech read-out data with emphasis as to the crucial portion included in the summary text.

In the recording medium having recorded thereon the electronic document processing program, according to the present invention, there may be provided such a program including a summary text forming step for forming a summary text of the electronic document and a document read out step of reading out a portion of the electronic document included in the summary text with emphasis as compared to the portion thereof not included in the summary text.

So, with the recording medium having recorded thereon the electronic document processing program, according to the present invention, there may be provided such an electronic document processing program which enables the portion of the electronic document contained in the summary text to be directly read out with emphasis as compared to the document portion not contained in the summary text. Thus, an apparatus furnished with this electronic document processing program is able to read any optional electronic document out highly accurately without extraneous feeling using the speech read-out data with emphasis as to the crucial portion included in the summary text.

The electronic document processing apparatus for processing an electronic document according to the present invention includes detection means for detecting beginning positions of at least two of the paragraph, sentence and phrase among plural elements making up the electronic document, and speech read-out data generating means for reading the electronic document out by the speech synthesizer by adding to the electronic document speech read-out data the attribute information indicating providing respective different pause periods at beginning positions of at least two of the paragraph, sentence and phrase based on detected results obtained by the detection means.

So, with the electronic document processing apparatus, according to the present invention, the attribute information indicating providing respective different pause periods at beginning positions of at least two of the paragraph, sentence and phrase is added to generate speech read-out data whereby speech read-out data may be read out highly accurately without extraneous feeling by speech synthesis by generating speech read-out data by providing different pause periods at beginning positions of at least two of the paragraph, sentence and phrase.

The electronic document processing method for processing an electronic document according to the present invention includes a detection step of detecting beginning positions of at least two of the paragraph, sentence and phrase among plural elements making up the electronic document and a speech read-out data generating step of reading the electronic document out by the speech synthesizer by adding to the electronic document speech read-out data the attribute information indicating providing respective different pause periods at beginning positions of at least two of the paragraph, sentence and phrase based on detected results obtained by the detection means.

So, with the electronic document processing method for processing an electronic document, according to the present invention, the attribute information indicating providing respective different pause periods at beginning positions of at least two of the paragraph, sentence and phrase to generate speech read-out data is added to render it possible to read any optional electronic document out highly accurately without extraneous feeling using the speech read-out data.

In the recording medium having recorded thereon a computer-controllable electronic document processing program for processing an electronic document, according to the present invention, the program includes a detection step of detecting beginning positions of at least two of the paragraph, sentence and phrase among plural elements making up the electronic document, and a step of generating speech read-out data for reading out in a speech synthesizer by adding to the electronic document the attribute information indicating providing respective different pause periods at beginning positions of at least two of the paragraph, sentence and phrase.

So, with the recording medium, having recorded thereon the electronic document processing program, according to the present invention, the attribute information indicating providing respective different pause periods at beginning positions of at least two of the paragraph, sentence and phrase, is added to generate speech read-out data. Thus, an apparatus furnished with this electronic document processing program is able to read any optional electronic document out highly accurately without extraneous feeling using the speech read-out data.

The electronic document processing apparatus for processing an electronic document according to the present invention includes detection means for detecting beginning positions of at least two of the paragraph, sentence and phrase among plural elements making up the electronic document, and document read out means for speech-synthesizing and reading out the electronic document by providing respective different pause periods at beginning positions of at least two of the paragraph, sentence and phrase, based on the result of detection by the detection means.

Thus, the electronic document processing apparatus, according to the present invention, is able to directly read out any optional electronic document by speech synthesis by providing respective different pause periods at beginning positions of at least two of the paragraph, sentence and phrase.

The electronic document processing method for processing an electronic document according to the present invention includes a detection step for detecting beginning positions of at least two of the paragraph, sentence and phrase among plural elements making up the electronic document, and a document read out step for speech-synthesizing and reading out the electronic document by providing respective different pause periods at beginning positions of at least two of the paragraph, sentence and phrase, based on the result of detection by the detection step.

So, the electronic document processing method for processing an electronic document renders it possible to read any optional electronic document out highly accurately without extraneous feeling by providing respective different pause periods at beginning positions of at least two of the paragraph, sentence and phrase.

In the recording medium having recorded thereon a computer-controllable electronic document processing program for processing an electronic document, according to the present invention, the program includes a detection step for detecting beginning positions of at least two of the paragraph, sentence and phrase among plural elements making up the electronic document, and a document read out step for speech-synthesizing and reading out the electronic document by providing respective different pause periods at beginning positions of at least two of the paragraph, sentence and phrase, based on the result of detection by the detection step.

So, with the recording medium having recorded thereon the electronic document processing program, according to the present invention, there may be provided an electronic document processing program which allows to directly read out any optional electronic document by providing respective different pause periods at beginning positions of at least two of the paragraph, sentence and phrase. Thus, an apparatus furnished with this electronic document processing program is able to read any optional electronic document out highly accurately without extraneous feeling by speech synthesis.

What is claimed is:

1. An electronic document processing apparatus for processing an electronic document, comprising:

summary text forming means for forming a summary text of said electronic document; and speech read-out data generating means for generating speech read-out data for reading said electronic document out by a speech synthesizer;

said speech read-out data generating means generating said speech read-out data as the attribute information indicating reading out a portion of said electronic document included in said summary text with emphasis as compared to a portion thereof not included in said summary text.

2. The electronic document processing apparatus according to claim 1 wherein said attribute information includes the attribute information indicating an increased sound volume in reading out the document portion included in said summary text as compared to the sound volume in reading out the document portion not included in said summary text.

3. The electronic document processing apparatus according to claim 2 wherein said attribute information indicating the increased sound volume is represented by the percentage of the increased volume to the standard volume.

4. The electronic document processing apparatus according to claim 1 wherein said attribute information includes the attribute information for emphasizing the accent in reading the portion of said electronic document included in said summary text.

5. The electronic document processing apparatus according to claim 1 wherein said attribute information includes the attribute information for imparting characteristics of the speech in reading out the portion of the electronic document included in said summary text different from those of the speech in reading out the portion of the electronic document not included in said summary text.

6. The electronic document processing apparatus according to claim 1 wherein said speech read-out data generating means adds the tag information necessary in reading out the electronic document by said speech synthesizer.

7. The electronic document processing apparatus according to claim 1 wherein said summary text forming means sets the size of a summary text display area in which said summary text of the electronic document is displayed;

the length of said summary text of the electronic document is determined responsive to the size of the summary text display area as set; and wherein a summary text of a length to be comprised in said summary text display area is formed based on the length of the summary text as determined.

8. The electronic document processing apparatus according to claim 1 wherein the tag information indicating the inner structure of said electronic document of a hierarchical structure having a plurality of elements is added to said electronic document.

9. The electronic document processing apparatus according to claim 8 wherein the tag information indicating at least paragraphs, sentences and phrases, among a plurality of elements making up the electronic document is added to the electronic document; and wherein said speech read-out data generating means discriminates the paragraphs, sentences and phrases making up the electronic document based on the tag information indicating said paragraphs, sentences and phrases.

10. The electronic document processing apparatus according to claim 8 wherein the tag information necessary for reading out by said speech synthesizer is added to said electronic document.

11. The electronic document processing apparatus according to claim 10 wherein the tag information necessary for reading out by said speech synthesizer includes the attribute information for inhibiting the reading out.

12. The electronic document processing apparatus according to claim 10 wherein the tag information necessary for reading out by said speech synthesizer includes the attribute information indicating the pronunciation.

13. The electronic document processing apparatus according to claim 1 wherein said speech read-out data generating means adds to said electronic document the attribute information specifying the language with which the electronic document is formed to generate said speech read-out data.

14. The electronic document processing apparatus according to claim 1 wherein said speech read-out data generating means adds to said electronic document the attribute information specifying the beginning positions of the paragraphs, sentences and phrases making up the electronic document to generate said speech read-out data.

15. The electronic document processing apparatus according to claim 14 wherein if the attribute information representing a homologous syntactic structure among the attribute information specifying the beginning positions of the paragraphs, sentences and phrases appear in succession in said electronic document, said speech read-out data generating means unifies said attribute information appearing in succession into one attribute information.

16. The electronic document processing apparatus according to claim 14 wherein said speech read-out data generating means adds to said electronic document the attribute information indicating provision of said pause period to said electronic document directly before the attribute information specifying the beginning positions of said paragraph, sentence and phrase, to generate said speech read-out data.

17. The electronic document processing apparatus according to claim 1 wherein said speech read-out data generating means adds to said electronic document the attribute information indicating the read-out inhibited portion of said electronic document to generate said speech read-out data.

18. The electronic document processing apparatus according to claim 1 wherein said speech read-out data generating means adds to said electronic document the attribute information indicating correct reading or pronunciation to generate said speech read-out data.

19. The electronic document processing apparatus according to claim 1 further comprising:

processing means for performing processing suited to a speech synthesizer using said speech read-out data;

said processing means finding an absolute value of the read-out sound volume based on the attribute information added to said speech read-out data for indicating the read-out sound volume.

20. The electronic document processing apparatus according to claim 1 further comprising:

processing means for performing processing suited to a speech synthesizer using said speech read-out data;

said processing means finding an absolute value of the read-out sound volume based on the attribute information added to said speech read-out data for indicating the language with which said electronic document is formed.

21. The electronic document processing apparatus according to claim 1 further comprising:

document read-out means for reading said electronic document out based on said speech read-out data.

22. The electronic document processing method according to claim 21 wherein said document read-out step locates in terms of said paragraph, sentence and phrase making up said electronic document as unit, based on the attribute information specifying the beginning position of said paragraph, sentence and phrase.

23. An electronic document processing apparatus for processing an electronic document, comprising:

a summary text forming step of forming a summary text of said electronic document; and a speech read-out data generating step of generating speech read-out data for reading said electronic document out by a speech synthesizer;

said speech read-out data generating step generating said speech read-out data as the attribute information indicating reading out a portion of said electronic document included in said summary text with emphasis as compared to a portion thereof not included in said summary text.

24. The electronic document processing method according to claim 23 wherein said attribute information includes the attribute information indicating an increased sound volume in reading out the document portion included in said summary text as compared to the sound volume in reading out the document portion not included in said summary text.

25. The electronic document processing method according to claim 24 wherein said attribute information indicating the increased sound volume is represented by the percentage of the increased volume to the standard volume.

26. The electronic document processing method according to claim 23 wherein said attribute information includes the attribute information for emphasizing the accent in reading the portion of said electronic document included in said summary text.

27. The electronic document processing method according to claim 23 wherein said attribute information includes the attribute information for imparting characteristics of the speech in reading out the portion of the electronic document included in said summary text different from those of the speech in reading out the portion of the electronic document not included in said summary text.

28. The electronic document processing method according to claim 23 wherein said speech read-out data generating step adds the tag information necessary in reading out the electronic document by said speech synthesizer.

29. The electronic document processing method according to claim 23 wherein said summary text forming step sets the size of a summary text display area in which said summary text of the electronic document is displayed;

the length of said summary text of the electronic document is determined responsive to the size of the summary text display area as set; and wherein a summary text of a length to be comprised in said summary text display area is formed based on the length of the summary text as determined.

30. The electronic document processing method according to claim 23 wherein the tag information indicating the inner structure of said electronic document of a hierarchical structure having a plurality of elements is added to said electronic document.

31. The electronic document processing method according to claim 30 wherein the tag information indicating at least paragraphs, sentences and phrases, among a plurality of elements making up the electronic document, is added to the electronic document; and wherein said speech read-out data generating step discriminating the paragraphs, sentences and phrases making up the electronic document based on the tag information indicating said paragraphs, sentences and phrases.

32. The electronic document processing method according to claim 30 wherein the tag information necessary for reading out by said speech synthesizer is added to said electronic document.

33. The electronic document processing method according to claim 32 wherein the tag information necessary for reading out by said speech synthesizer includes the attribute information for inhibiting the reading out.

34. The electronic document processing method according to claim 32 wherein the tag information necessary for reading out by said speech synthesizer includes the attribute information indicating the pronunciation.

35. The electronic document processing method according to claim 23 wherein said speech read-out data generating step adds to said electronic document the attribute information specifying the language with which the electronic document is formed to generate said speech read-out data.

36. The electronic document processing method according to claim 23 wherein said speech read-out data generating step adds to said electronic document the attribute information specifying the beginning positions of the paragraphs, sentences and phrases making up the electronic document to generate said speech read-out data.

37. The electronic document processing method according to claim 36 wherein if the attribute information representing a homologous syntactic structure among the attribute information specifying the beginning positions of the paragraphs, sentences and phrases appear in succession in said electronic document, said speech read-out data generating step unifies said attribute information appearing in succession into one attribute information.

38. The electronic document processing method according to claim 36 wherein said speech read-out data generating step adds to said electronic document the attribute information indicating provision of said pause period to said electronic document directly before the attribute information specifying the beginning positions of said paragraph, sentence and phrase, to generate said speech read-out data.

39. The electronic document processing method according to claim 23 wherein said speech read-out data generating step adds to said electronic document the attribute information indicating the read-out inhibited portion of said electronic document to generate said speech read-out data.

40. The electronic document processing method according to claim 23 wherein said speech read-out data generating step adds to said electronic document the attribute information indicating correct reading or pronunciation to generate said speech read-out data.

41. The electronic document processing method according to claim 23 further comprising:

a processing step of performing processing suited to a speech synthesizer using said speech read-out data;

said processing step finding an absolute value of the read-out sound volume based on the attribute information added to said speech read-out data for indicating the read-out sound volume.

42. The electronic document processing method according to claim 23 further comprising:

a processing step of performing processing suited to a speech synthesizer using said speech read-out data;

said processing step finding an absolute value of the read-out sound volume based on the attribute information added to said speech read-out data for indicating the language with which said electronic document is formed.

43. The electronic document processing method according to claim 23 further comprising:

a document read-out step of reading said electronic document out based on said speech read-out data.

44. The electronic document processing method according to claim 43 wherein said document read-out step locates in terms of said paragraph, sentence and phrase making up said electronic document as unit, based on the attribute information specifying the beginning position of said paragraph, sentence and phrase.

45. A recording program having recorded thereon a computer-controllable program for processing an electronic document, said program comprising:

a summary text forming step of forming a summary text of said electronic document; and a speech read-out data generating step of generating speech read-out data for reading said electronic document out by a speech synthesizer;

said speech read-out data generating step generating said speech read-out data as the attribute information indicating reading out a portion of said electronic document included in said summary text with emphasis as compared to a portion thereof not included in said summary text.

46. An electronic document processing apparatus for processing an electronic document, comprising:

summary text forming means for preparing a summary text of said electronic document; and document read-out means for reading out a portion of said electronic document included in said summary text with emphasis as compared to a portion thereof not included in said summary text.

47. The electronic document processing apparatus according to claim 46 wherein said document read-out means reads out said electronic document with a sound volume in reading out a portion of said electronic document included in said summary text which is increased as compared to that in reading out a portion of said electronic document not included in said summary text.

48. The electronic document processing apparatus according to claim 46 wherein said document read-out means reads out said electronic document with an emphasis in accentuation in reading out a portion of said electronic document included in said summary text.

49. The electronic document processing apparatus according to claim 46 wherein said document read-out means reads out the portion of the electronic document included in said summary text with speech characteristics different from those in reading out the portion of the electronic document not included in said summary text.

50. The electronic document processing apparatus according to claim 46 wherein said summary text forming means sets the size of a summary text display area in which said summary text of the electronic document is displayed;

the length of said summary text of the electronic document is determined responsive to the size of the summary text display area as set; and wherein a summary text of a length to be comprised in said summary text display area is formed based on the length of the summary text as determined.

51. The electronic document processing apparatus according to claim 46 further comprising:

document inputting means for being fed with said electronic document of a hierarchical structure having a plurality of elements and having added thereto the tag information indicating its inner structure.

52. The electronic document processing apparatus according to claim 51 wherein the electronic document, added with the tag information indicating at least paragraphs, sentences and phrases, among a plurality of elements making up the electronic document, is input to said document inputting means; and wherein said document read-out means reads said electronic document out by providing pause periods at the beginning positions of said paragraphs, sentences and phrases, based on the tag information specifying said paragraphs, sentences and phrases.

53. The electronic document processing apparatus according to claim 51 wherein the tag information indicating at least paragraphs, sentences and phrases, among a plurality of elements making up the electronic document, is added to the electronic document; and wherein said document read-out means discriminates the paragraphs, sentences and phrases making up the electronic document based on the tag information indicating said paragraphs, sentences and phrases.

54. The electronic document processing apparatus according to claim 51 wherein the tag information necessary for reading out by said document read-out means is added to said electronic document.

55. The electronic document processing apparatus according to claim 54 wherein the tag information necessary for reading out by said document read-out means includes the attribute information for inhibiting the reading out.

56. The electronic document processing apparatus according to claim 54 wherein the tag information necessary for reading out by said document read-out means includes the attribute information indicating the pronunciation.

57. The electronic document processing apparatus according to claim 46 wherein said document read-out means reads out said electronic document as a read-out inhibited portion of said electronic document is excepted.

58. The electronic document processing apparatus according to claim 46 wherein said document read-out means reads out said electronic document with substitution by correct reading or pronunciation.

59. The electronic document processing apparatus according to claim 51 wherein said document read-out means locates in terms of said paragraph, sentence and phrase making up said electronic document as unit, based on the attribute information specifying the beginning position of said paragraph, sentence and phrase.

60. An electronic document processing method for processing an electronic document, comprising:

a summary text forming step for forming a summary text of said electronic document; and a document read out step of reading out a portion of said electronic document included in said summary text with emphasis as compared to the portion thereof not included in said summary text.

61. The electronic document processing method according to claim 60 wherein in said document read out step, the electronic document is read out with a sound volume for a portion of the electronic document included in the summary text which is increased as compared to that for a portion of the electronic document not included in the summary text.

62. The electronic document processing method according to claim 60 wherein said document read-out step reads out said electronic document with an emphasis in accentuation in reading out a portion of said electronic document included in said summary text.

63. The electronic document processing method according to claim 60 wherein said document read-out step reads out the portion of the electronic document included in said summary text with speech characteristics different from those in reading out the portion of the electronic document not included in said summary text.

64. The electronic document processing method according to claim 60 wherein said summary text forming step sets the size of a summary text display area in which said summary text of the electronic document is displayed;

the length of said summary text of the electronic document is determined responsive to the size of the summary text display area as set; and wherein a summary text of a length to be comprised in said summary text display area is formed based on the length of the summary text as determined.

65. The electronic document processing method according to claim 60 further comprising:

a document inputting step of being fed with said electronic document of a hierarchical structure having a plurality of elements and having added thereto the tag information indicating its inner structure.

66. The electronic document processing method according to claim 65 wherein the electronic document, added with the tag information indicating at least paragraphs, sentences and phrases, among a plurality of elements making up the electronic document, is input to said document inputting step; and wherein said document read-out step reads said electronic document out by providing pause periods at the beginning positions of said paragraphs, sentences and phrases, based on the tag information specifying said paragraphs, sentences and phrases.

67. The electronic document processing method according to claim 65 wherein the tag information indicating at least paragraphs, sentences and phrases, among a plurality of elements making up the electronic document, is added to the electronic document; and wherein said document read-out step discriminates the paragraphs, sentences and phrases making up the electronic document based on the tag information indicating said paragraphs, sentences and phrases.

68. The electronic document processing method according to claim 65 wherein the tag information necessary for reading out by said document read-out step is added to said electronic document.

69. The electronic document processing method according to claim 68 wherein the tag information necessary for reading out by said document read-out step includes the attribute information for inhibiting the reading out.

70. The electronic document processing method according to claim 68 wherein the tag information necessary for reading out by said document read-out step includes the attribute information indicating the pronunciation.

71. The electronic document processing method according to claim 60 wherein said document read-out step reads out said electronic document as a read-out inhibited portion of said electronic document is excepted.

72. The electronic document processing method according to claim 60 wherein said document read-out step reads out said electronic document with substitution by correct reading or pronunciation.

73. The electronic document processing method according to claim 65 wherein said document read-out step locates in terms of said paragraph, sentence and phrase making up said electronic document as unit, based on the attribute information specifying the beginning position of said paragraph, sentence and phrase.

74. A recording medium having recorded thereon a computer-controllable electronic document processing program for processing an electronic document, said program comprising:

a summary text forming step for forming a summary text of said electronic document; and a document read out step of reading out a portion of said electronic document included in said summary text with emphasis as compared to the portion thereof not included in said summary text.

* * * * *